US011441380B2

(12) United States Patent
Moyes

(10) Patent No.: US 11,441,380 B2
(45) Date of Patent: Sep. 13, 2022

(54) JARRING APPARATUS

(71) Applicant: Rotojar Innovations Limited, Banchory Aberdeenshire (GB)

(72) Inventor: Peter Barnes Moyes, Aberdeenshire (GB)

(73) Assignee: ROTOJAR INNOVATIONS LIMITED, Aberdeenshire (GB)

( * ) Notice: Subject to any disclaimer, the term of this patent is extended or adjusted under 35 U.S.C. 154(b) by 50 days.

(21) Appl. No.: 16/963,003

(22) PCT Filed: Jan. 15, 2019

(86) PCT No.: PCT/GB2019/050103
§ 371 (c)(1),
(2) Date: Jul. 17, 2020

(87) PCT Pub. No.: WO2019/141975
PCT Pub. Date: Jul. 25, 2019

(65) Prior Publication Data

US 2020/0340321 A1 Oct. 29, 2020

(30) Foreign Application Priority Data

Jan. 19, 2018 (GB) ..... 1800895
Oct. 11, 2018 (GB) ..... 1816591
Nov. 6, 2018 (GB) ..... 1818097

(51) Int. Cl.
*E21B 31/113* (2006.01)
*E21B 4/14* (2006.01)
*E21B 31/00* (2006.01)

(52) U.S. Cl.
CPC ..... *E21B 31/1135* (2013.01); *E21B 4/14* (2013.01); *E21B 31/005* (2013.01)

(58) Field of Classification Search
CPC .. E21B 31/005; E21B 31/107; E21B 31/1135; E21B 4/10; E21B 4/14
See application file for complete search history.

(56) References Cited

U.S. PATENT DOCUMENTS 1,535,935 A 4/1925 Mclean et al.
1,778,252 A 10/1930 Fentress
(Continued)

FOREIGN PATENT DOCUMENTS

GB 2501987 A 11/2013
WO WO-2014170686 A2 10/2014
(Continued)

OTHER PUBLICATIONS

International Report on Patentability and Written Opinion for PCT/GB2019/050103 dated Jul. 30, 2020.
(Continued)

*Primary Examiner* — Jennifer H Gay
(74) *Attorney, Agent, or Firm* — Harness, Dickey & Pierce, P.L.C.

(57) ABSTRACT

A jarring apparatus includes first and second jarring assemblies which are axially moveable relative to each other between first and second axial configurations, and a thrust assembly interposed between the first and second jarring assemblies to limit relative axial movement therebetween at the second axial configuration and permit axial loading in one axial direction to be transferred between the first and second jarring assemblies via the thrust assembly. The apparatus further includes a jarring mass axially moveable within the jarring apparatus in reverse first and second directions upon relative rotation between the first and second jarring assemblies.

29 Claims, 22 Drawing Sheets

(56) References Cited

U.S. PATENT DOCUMENTS

| | | | | |
|---|---|---|---|---|
| 1,901,513 | A * | 3/1933 | Ford | E21B 31/005 175/298 |
| 1,977,110 | A * | 10/1934 | Burns | E21B 31/107 175/304 |
| 2,153,883 | A | 4/1939 | Foster | |
| 2,550,142 | A * | 4/1951 | Dumble | E21B 31/107 175/303 |
| 3,139,933 | A | 7/1964 | Golden | |
| 4,023,630 | A * | 5/1977 | Perkin | E21B 31/107 175/297 |
| 4,036,312 | A * | 7/1977 | DeLuish | E21B 31/107 175/302 |
| 7,882,906 | B1 * | 2/2011 | DeCuir, Sr. | E21B 31/005 175/306 |
| 8,739,901 | B2 * | 6/2014 | Cote | E21B 4/10 175/296 |
| 9,624,725 | B2 * | 4/2017 | Cote | E21B 4/14 |
| 9,976,350 | B2 * | 5/2018 | von Gynz-Rekowski | E21B 4/10 |
| 10,280,700 | B2 * | 5/2019 | Moyes | E21B 31/113 |
| 10,781,655 | B2 * | 9/2020 | Moyes | E21B 31/107 |
| 11,060,371 | B2 * | 7/2021 | Moyes | E21B 31/1135 |
| 2004/0089461 | A1 * | 5/2004 | Cioceanu | E21B 4/10 173/90 |
| 2007/0074909 | A1 * | 4/2007 | Chancey | E21B 41/00 175/296 |
| 2011/0031020 | A1 * | 2/2011 | Cote | E21B 1/02 175/56 |
| 2014/0150576 | A1 | 6/2014 | Gregory | |
| 2014/0338978 | A1 * | 11/2014 | Cote | F16L 15/001 175/57 |
| 2015/0107904 | A1 * | 4/2015 | Kerstetter | E21B 17/03 175/57 |
| 2016/0273294 | A1 * | 9/2016 | Moyes | E21B 31/107 |
| 2019/0071945 | A1 * | 3/2019 | Moyes | E21B 31/107 |
| 2020/0340321 | A1 * | 10/2020 | Moyes | E21B 4/14 |

FOREIGN PATENT DOCUMENTS

| | | | |
|---|---|---|---|
| WO | WO-2016126258 | A1 | 8/2016 |
| WO | WO-2017056026 | A1 | 4/2017 |

OTHER PUBLICATIONS

International Search Report PCT/ISA/210 for International Application No. PCT/GB2019/050102 dated Apr. 12, 2019.

Wriiten Opinion of the International Searching Authority PCT/ISA/237 for International Application No. PCT/GB2019/050102 dated Apr. 12, 2019.

Great Britain Office Action 1800895.3 dated Jun. 11, 2018.

Great Britain Office Action 1816591.0 dated Apr. 17, 2019.

Great Britain Office Action GB1818097.6 dated Apr. 12, 2019.

* cited by examiner

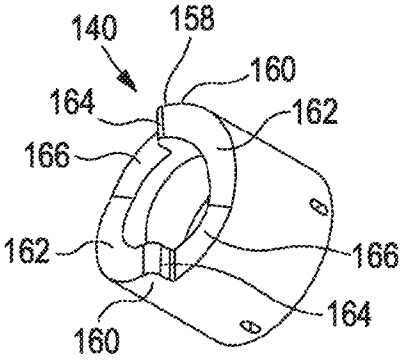
FIGURE 10
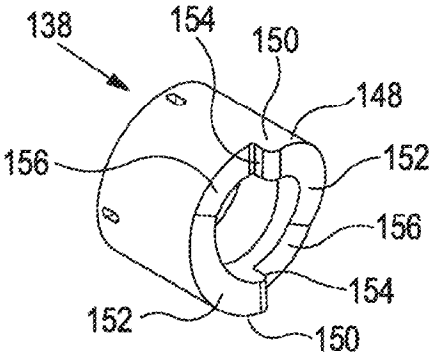
FIGURE 9
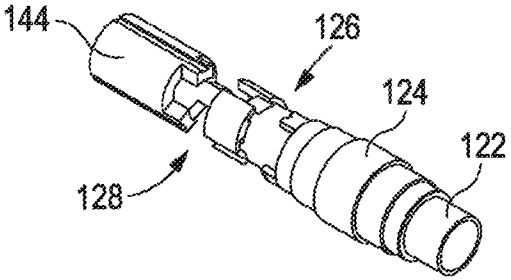
FIGURE 8
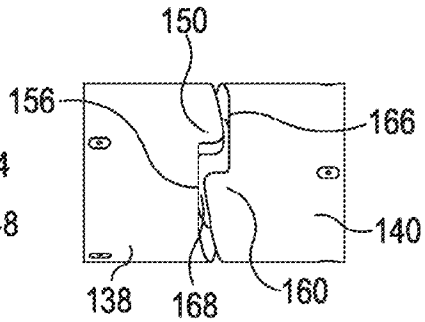
FIGURE 11A
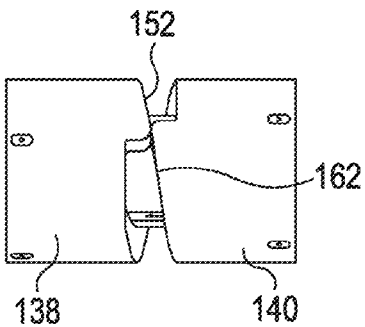
FIGURE 11B
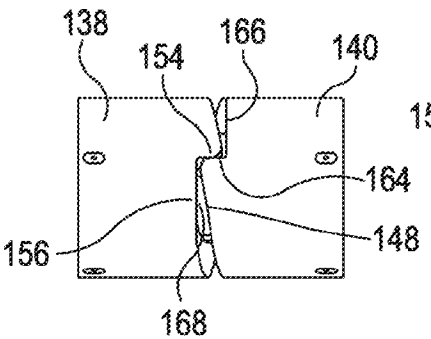
FIGURE 11C
FIGURE 11D

JARRING APPARATUS

This application is a national phase under 35 U.S.C. § 371 of PCT International Application No. PCT/GB2019/050103 which has an International filing date of Jan. 15, 2019, which claims priority to Great Britain Patent Application No. 1800895.3, filed Jan. 19, 2018, Great Britain Patent Application No. 1816591.0, filed Oct. 11, 2018, and Great Britain Patent Application No. 1818097.6, filed Nov. 6, 2018, the entire contents of each of which are hereby incorporated by reference.

FIELD

The present disclosure relates to a jarring apparatus and associated methods.

BACKGROUND

Many industries require the application of jarring forces to support certain operations. For example, in the oil and gas exploration and production industry jarring tools might be used downhole in numerous applications, such as in drilling applications, running/retrieving equipment, cementing operations and the like.

Generally, a jarring tool is a device used to deliver an impact load to another component. Known jarring tools operate by storing energy, such as in a drilling string, for example by applying tension within the string, and suddenly releasing this energy to cause two impact surfaces to move axially and strike each other, creating an impact or jarring force.

Jarring tools are known which operate in response to a linear activation input, and are thus typically known as linear jarring tools. Proposals have also been made concerning jarring tools which can provide a linear jar in response to a rotational drive input.

An example known rotary jarring tool is illustrated in FIG. 1. In this example the jarring tool 1 is for use in a wellbore and includes a housing 2 and a mandrel 3 which extends into the housing 2, wherein the mandrel 3 is connected to a drill string 4. The housing 2 and mandrel 3 include respective annular cams 5, 6, also illustrated in FIG. 2, which each include a plurality of circumferentially arranged ramped cam teeth 7. During operation, the housing 2 may be held static or otherwise impeded in the wellbore, for example by virtue of being stuck or being connected to an object or load, and tension is applied within the mandrel 3 via the connected drill string 4 which generates an axial load between the cams 5, 6. The mandrel 3 is rotated relative to the impeded housing 2, thus causing the ramped cam teeth 7 of the cams 5, 6 to slide over each other in a cyclical axial lifting and dropping motion, with each drop causing the cams 5, 6 to rapidly impact against each other and generate a jarring force. The jarring force is proportional to the tension applied in the drill string 4, and a jarring frequency may be provided which is a function of the rotational speed and the number of cam teeth present.

While such a known rotary jarring tool may provide benefits in many applications, some potential issues have been recognised by the present inventor. For example, the longevity of the tool may be severely restricted by virtue of the cams being used to provide both the axial lifting and impact. Also, the nature of the cams is such that as the cam teeth approach their peak displacement the contact surface area reduces which can generate very significant stresses within the cams, theoretically tending to infinity at the drop-off point. Further, as all load through the tool is transmitted at the interface between the cams, issues associated with wear and damage may be more prominent in high load applications, for example when excessive tension is applied in the drill string, either intentionally due to specific jarring requirements or indeed accidentally due to operator error, and/or when a large load is supported by the housing.

An example of a known jarring tool is provided in U.S. Pat. No. 7,882,906

SUMMARY

An aspect of the present disclosure relates to a jarring apparatus, comprising:

- first and second jarring assemblies axially moveable relative to each other between first and second axial configurations;
- a thrust assembly interposed between the first and second jarring assemblies to limit relative axial movement therebetween at the second axial configuration and permit axial loading in one axial direction to be transferred between the first and second jarring assemblies via the thrust assembly; and
- a jarring mass axially moveable within the jarring apparatus in reverse first and second directions in response to relative rotation between the first and second jarring assemblies.

The apparatus may comprise a force mechanism for biasing the jarring mass in its first axial direction. The force mechanism may bias the first and second jarring assemblies in a direction towards their first axial configuration.

The apparatus may comprise a lifting assembly operable by relative rotation between the first and second jarring assemblies to cause the jarring mass to move in reverse first and second directions. The lifting apparatus may be configured to cyclically lift the jarring mass in the second axial direction against the bias of a force mechanism and release the lifted jarring mass to permit the jarring mass to be driven by the force mechanism in the first direction.

An aspect of the present disclosure relates to a jarring apparatus, comprising:

- first and second jarring assemblies axially moveable relative to each other between first and second axial configurations;
- a thrust assembly interposed between the first and second jarring assemblies to limit relative axial movement therebetween at the second axial configuration and permit axial loading in one axial direction to be transferred between the first and second jarring assemblies via the thrust assembly;
- a jarring mass axially moveable within the jarring apparatus in reverse first and second directions;
- a force mechanism for biasing the jarring mass in its first axial direction and for biasing the first and second jarring assemblies in a direction towards their first axial configuration; and
- a lifting assembly operable by relative rotation between the first and second jarring assemblies to cyclically lift the jarring mass in the second axial direction against the bias of the force mechanism and release the lifted jarring mass to permit the jarring mass to be driven by the force mechanism in the first direction.

It should be understood that the term "lift" or "lifting" with reference to the jarring mass is not intended to be limited to an increase in vertical height, but is instead used to define any displacement of the jarring mass in the second direction against the bias of the force mechanism, irrespective of the orientation of the jarring apparatus. In a similar manner, the release and movement of the jarring mass in the first direction may be defined as a dropping motion of the jarring mass.

In use, a repeated jarring force may be generated by the reciprocating axial motion of the jarring mass as it is cyclically lifted and released by the lifting assembly during relative rotation between the first and second jarring assemblies. In particular, the movement of the jarring mass in the first direction under the action or drive of the force mechanism may permit a jarring force to be generated. As such, the jarring force may be a function of the bias force provided by the force mechanism. The provision of the force mechanism to bias the jarring mass in the first direction may provide an internal or on-board energy source for use in delivering the desired jarring force. Such an arrangement may allow any forces applied within or through the lifting assembly to be a function of the capacity or rating of the force mechanism. This may contribute to providing a degree of protection to the lifting assembly.

As jarring forces are generated by relative rotation between the first and second jarring assemblies, the jarring apparatus may be defined as a rotary jarring apparatus.

At least one of the first and second jarring assemblies may be engaged with an object such that the jarring forces generated within the jarring apparatus may be applied to said object. The object may comprise anything which might require the application of a jarring force, such as to deploy the object, retrieve the object, free the object when stuck, activate the object, install the object, drive the object, pile the object and/or the like.

The thrust assembly limits relative axial movement between the first and second jarring assemblies at their second axial configuration, which may also be defined as a limit position or configuration. In this respect, relative axial movement of the first and second jarring assemblies in a direction from the first axial configuration will be limited at the second axial configuration. The thrust assembly may permit relative axial movement between the first and second jarring assemblies in a direction from the second axial configuration towards the first axial configuration. As such, the thrust assembly may be considered to be axially unidirectional.

When the thrust assembly is engaged at the second axial configuration axial load transference in one axial direction is permitted. This axial direction may be the direction of relative movement between the first and second jarring assemblies to be reconfigured from the first axial configuration to the second axial configuration. The load transference via the thrust assembly in this regard may prevent or divert any excessive axial loading between the first and second assemblies from being transmitted through the force mechanism and applied within the lifting assembly, thus providing a degree of protection to the lifting assembly. In this respect the thrust assembly may function or define a load limiter.

As presented above, the force mechanism provides a dual biasing function: biasing the jarring mass in its first axial direction; and biasing the first and second jarring assemblies in a direction towards their first axial configuration.

The force mechanism may be energised by movement of the jarring mass in its second direction and relative axial movement between the first and second jarring assemblies towards their second configuration.

The force mechanism may be of a displacement type, which generates a force as a function (linearly or otherwise) of its displacement. The force mechanism may be displaced in a common direction by movement (lifting) of the jarring mass in its second axial direction and by relative axial movement of the first and second jarring assemblies towards their second configuration. In this way, the biasing force may increase by lifting of the jarring mass and by relative movement between the first and second jarring assemblies towards their second configuration.

The force generated within the force mechanism may thus be a function of the relative axial movement of the first and second jarring assemblies towards their second configuration. A user may therefore be provided with a degree of control of the jarring force by controlling the relative axial displacement between the first and second jarring assemblies. However, the thrust assembly, by limiting relative axial movement between the first and second jarring assemblies at the second configuration, may provide a limiting effect on the displacement within the force mechanism and thus the force permitted to be generated. Any further increasing force applied between the first and second jarring assemblies may then be accommodated via the thrust assembly, preventing the further generation of force within the force mechanism, other than via the lifting assembly. As noted above, this limiting effect of the thrust assembly may provide a degree of protection to the lifting assembly during its operation.

In some examples the lifting of the jarring mass may establish a relatively small displacement of the force mechanism compared to that caused or permitted by relative axial movement of the first and second jarring assemblies towards their second configuration. In this case, the force generated within the force mechanism may be primarily a function of the relative displacement of the first and second jarring assemblies towards their second configuration, such that providing a limit to that relative displacement via the thrust assembly provides significant protection within the jarring apparatus.

Initial relative axial movement of the first and second jarring assemblies from their first configuration towards their second configuration may be permitted without corresponding operation (e.g., displacement) of the force mechanism. In some examples this initial relative movement between the jarring assemblies may permit another operation to be facilitated without being retarded by the force mechanism. For example, the initial relative movement between the first and second jarring assemblies may function to release a rotary coupling between the first and second jarring assemblies, which will be described in further detail below.

In some examples, the force mechanism may be inactive until the first and second jarring assemblies have achieved sufficient relative axial movement towards their second configuration to begin displacing the force mechanism. In an alternative example, the force mechanism may be preloaded such that operation may be permitted without any required displacement by relative axial movement between the first and second jarring assemblies. In such an alternative example any displacement by the relative axial movement between the jarring assemblies will function to increase the force developed in the force mechanism for use in a jarring operation.

The force mechanism may be interposed (e.g., axially interposed) between one of the first and second jarring assemblies and the jarring mass. The force mechanism may be operated on opposing sides or ends (e.g., axial sides or ends) thereof by one of the first and second jarring assembles and the jarring mass.

The force mechanism may directly bear on or engage one of the first and second jarring assemblies. In some examples the force mechanism may be engaged with one of the first and second jarring assemblies via a force load shoulder. The force load shoulder may continuously engage the force mechanism. Alternatively, where initial relative movement between the first and second jarring assemblies is permitted before operation of the force mechanism, the force load shoulder may be initially separated from and pick-up or engage the force mechanism during the course of relative movement between the first and second jarring assemblies in a direction towards the second configuration. In some examples the force load shoulder may be adjustable to provide flexibility in setting the pick-up point.

The force mechanism may directly bear on or engage the jarring mass. Alternatively, the jarring apparatus may comprise a bearing structure, such as a bearing sleeve, rod, arm or the like, which is interposed between the force mechanism and the jarring mass.

The force mechanism may comprise any suitable device, apparatus, assembly or means which is cable of functioning as described herein. In some examples the force mechanism may comprise a spring mechanism, such as a mechanical spring, gas spring or the like.

In some examples the force mechanism may be capable of developing a force in the range of, for example, from a few newtons to serval thousand kilonewtons (e.g., up to and beyond 4.5 MN).

The apparatus may comprise a cooling arrangement to permit cooling fluid to communicate with the force mechanism.

The jarring apparatus may comprise an arresting mechanism configured to arrest movement of the reciprocating mass when moving in the first axial direction under the action of the force mechanism. The arresting mechanism may be configured to rapidly arrest or decelerate the jarring mass. Such a rapid arrest may assist to provide a jarring force. That is, the jarring force may be a result of a force generated upon arresting the jarring mass when moving in its first direction.

The arresting mechanism may be provided by opposing impact surfaces. In examples where a jarring force is provided by impact within the apparatus, the jarring mass may be defined as a hammer. In one example the jarring mass may comprise a first impact surface, and one of the first and second jarring assemblies may comprise a second impact surface, wherein the first and second impact surfaces are configured to be impacted together when the jarring mass is driven in its first direction under the action of the force mechanism. In such an example, lifting of the jarring mass in its second direction by the lifting assembly may cause the first and second impact surfaces to separate.

The first impact surface may be integrally formed with the jarring mass. Alternatively, the first impact surface may be provided on a separate component, such as an impact or hammer head, which is coupled to the jarring mass.

The first and second impact surfaces may be provided separately from the lifting assembly. This may increase the longevity of the lifting assembly, by avoiding the lifting assembly having to perform a dual function of lifting and impacting.

The first and second impact surfaces may be provided within or exposed to a fluid which functions to cool and/or lubricate the impact surfaces during operation. The first and second impact surfaces may be exposed to a fluid provided via a flow path internally within the jarring apparatus. The first and second impact surfaces may be exposed to ambient fluid which functions to cool and/or lubricate the impact surfaces. In some examples the first and second impact surfaces may be provided within a flow path, such that a fluid may flow or circulate therethrough. In examples where the jarring apparatus may be used in a downhole environment, the impact surfaces may be exposed to a downhole fluid, such as an annulus fluid. The impact surfaces may be provided within a circulation path between a wellbore annulus region and a flow path internally within the jarring apparatus.

In some examples the impact surfaces may be provided within a clean environment, isolated from downhole fluids.

In other examples the arresting mechanism may not rely on, or entirely on, an impact between two surfaces. For example, the arresting mechanism may comprise a damping mechanism, such as a fluid damper, spring system or the like. In this example jarring may be achieved through reciprocating motion of the jarring mass. The jarring mass may thus be operated to reciprocally wobble, shake, agitate or like The jarring mass may be radially interposed between the first and second jarring assemblies. The jarring mass may be rotatably secured to one of the first and second jarring assemblies.

The jarring mass may comprise one or more components, for example one or more elongate components. The jarring mass may comprise one or more tubular or sleeve components.

The thrust assembly may comprise respective loading faces on the first and second jarring assemblies, wherein the respective loading faces are axially engaged when the first and second jarring assemblies reach their second axial configuration.

The thrust assembly may permit the first and second jarring assemblies to be rotatable relative to each other when in their second configuration.

The thrust assembly may comprise a thrust bearing or bearing assembly.

The lifting assembly may comprise a first lifting structure rotatably and axially fixed relative to one of the first and second jarring assemblies and a second lifting structure rotatably fixed and axially moveable relative to the other of the first and second jarring assemblies, wherein the second lifting structure acts axially, directly or indirectly, on the jarring mass. The first and second lifting structures may be configured to cooperate during relative rotation therebetween to cause the second lifting structure to be axially moved in cyclical lifting and dropping phases. During the lifting phase the second lifting structure may cause the jarring mass to be lifted in its second direction. The dropping phase of the first and second lifting structures may coincide with releasing the jarring mass. However, in some alternative examples release of the jarring mass may occur prior to the dropping phase between the first and second lifting structures. This may provide a degree of protection to the first and second lifting structures, which will be described in further detail below.

The dropping phase of the first and second lifting structures may be considered to function to reset the lifting structures in preparation for a subsequent lifting phase.

Loading may be applied between the first and second lifting structures which is a function of the biasing force provided by the force mechanism (via the jarring mass and second lifting structure). In this respect such loading may be controlled by appropriate selection of the force mechanism and by virtue of the load limiting effect of the thrust assembly. This may assist to increase the longevity of the first and second lifting structures, and thus of the lifting assembly.

The second lifting structure may be rotatably coupled to its associated jarring assembly via a connection which permits the second lifting structure to move axially. In this respect the associated jarring assembly is the jarring assembly to which the second lifting structure is connected. The connection may include, for example, a keyed connection, splined connection, castellated connection or the like.

The second lifting structure may be integrally formed with the jarring mass. Alternatively, the second lifting structure may be separately formed from the jarring mass. The second lifting structure may directly bear on or engage the jarring mass. Alternatively, the jarring apparatus may comprise a bearing structure, such as a bearing sleeve, rod, arm or the like, which is interposed between the second lifting structure and the jarring mass.

The first lifting structure may be permanently axially connected to its associated jarring assembly. In this respect the associated jarring assembly is the jarring assembly to which the first lifting structure is connected.

The first lifting structure may be releasably axially connected to its associated jarring assembly. Axial release of the first lifting structure may effectively permit axial release of the jarring mass to thus be driven in its first direction by the force mechanism. The force mechanism may thus also cause the first and second lifting structures to be moved in the same first direction. In some examples one or both of the first and second lifting structures may be permitted to move axially further than the jarring mass in the first direction. This may function to decouple the effect of the force mechanism from applying loading between the first and second lifting structures after a degree of axial movement in the first direction has been achieved. In one example an arresting mechanism (e.g., impact surfaces) may provide such a decoupling function.

In one example the first lifting structure may be axially releasable from its associated jarring assembly prior to initiation of the dropping phase. Accordingly, release of the jarring mass to generate a jarring force may not be initiated or caused by transition of the lifting structures to the dropping phase, thus affording protection to the lifting structures and contributing to addressing or at least mitigating problems associated with prior art rotary jarring tools. This may assist to prolong the operational life of the lifting structures.

Axial release of the first lifting structure may function to release or reduce, for example significantly reduce, loading applied between the first and second lifting structures prior to initiation of the dropping phase. This arrangement may assist to minimise wear and/or risk of damage or failure occurring within the lifting structures.

The first lifting structure may remain axially released relative to its associated jarring assembly during a transition from the lifting phase to the dropping phase. In some examples the first lifting structure may remain axially released relative to its associated jarring assembly during at least a portion, for example the entirety of the dropping phase. Accordingly, the dropping phase may be initiated and optionally completed with minimised loading applied between the first and second lifting structures, which may assist to provide protection to the lifting structures and prolong their operational lifespan.

The first lifting structure may become axially fixed relative to its associated jarring assembly in advance of a subsequent lifting phase. The first lifting structure may become axially fixed relative to its associated jarring assembly upon initiation of a subsequent lifting phase. The first lifting structure may become axially fixed relative to its associated jarring assembly during the course of a subsequent lifting phase.

In some examples the first lifting structure may be axially released relative to its associated jarring assembly prior to completion of the lifting phase. In such an arrangement relative axial displacement between the first and second lifting structures may continue under reduced loading to complete the lifting phase.

The first and second lifting structures may comprise inter-engaging profiles which cooperate during relative rotation of the lifting structures to cause the cyclical lifting and dropping phases. The inter-engaging profiles may be configured such that a surface area of contact therebetween reduces as the lifting phase progresses. When exposed to load such a reducing surface area of contact results in increasing stresses applied between the inter-engaging profiles of the first and second lifting structures. As such, axially releasing the first lifting structure prior to completion of the lifting phase may prevent excessive loading being applied over the reducing surface area of contact, reducing stresses applied and minimising wear and risk of damage or failure.

In some examples the timing of the axial release of the first lifting structure may be adjustable. Such adjustment may be achieved prior to deployment and use of the jarring apparatus. In some examples, such adjustment may be achieved while the jarring apparatus is deployed and/or in use.

The inter-engaging profiles may permit at least one cycle of lifting and dropping phases for a single 360 degrees of relative rotation between the first and second lifting structures. In one example the inter-engaging profiles may permit multiple cycles (such as 2, 3, 4 etc.) of lifting and dropping phases for a single 360 degrees of relative rotation.

The inter-engaging profiles may be configured for rotating sliding engagement therebetween. The inter-engaging profiles may be defined by circumferential ramp structures. In one example the inter-engaging profiles may comprise rotary cam surfaces. In such examples the first and second lifting structures may define respective first and second lifting cams. The number of individual cam profiles provided on each lifting structure may dictate the number of lifting and dropping phases provided for a single 360 degrees of relative rotation between the lifting structures.

The inter-engaging profiles may comprise or be defined by a track and follower arrangement.

The inter-engaging profiles of the first and second lifting structures may be prevented from axial impact during or following the dropping phase. Such an arrangement may function to minimise wear and/or damage to the inter-engaging profiles. In one example one or both of the first and second lifting structures may comprise a no-go profile which functions to prevent axial impact of the inter-engaging profiles following the dropping phase. In some examples the first lifting structure may include a no-go profile, such as an annular lip, ring or the like, configured to interact with the second jarring assembly to prevent axial impact between the inter-engaging profiles of the first and second lifting structures.

The inter-engaging profiles may remain separated during a portion of relative rotation between the first and second lifting structures following the dropping phase. Such relative rotation without contact may define a transition phase between the dropping phase and a subsequent lifting phase.

The inter-engaging profiles may be brought into contact during relative rotation to initiate a subsequent lifting phase.

The first lifting structure by being axially releasable relative to its associated jarring assembly may be defined as a shuttle lifting structure.

The lifting phase may be achieved during a first relative rotational displacement between the first and second lifting structures.

The dropping phase may be achieved substantially instantaneously upon completion of the lifting phase. Alternatively, the dropping phase may be achieved during a second relative rotational displacement between the first and second lifting structures.

One of the first and second jarring assemblies may extend into the other of the first and second jarring assemblies. In some examples the first and second jarring assemblies may be coaxially aligned with each other. In other examples the first and second jarring assemblies may be eccentrically aligned relative to each other.

The first and second lifting structures may be interposed, for example radially interposed between the first and second jarring assemblies. In one example, the first and second lifting structures may be positioned within a radial space, such as an annular space defined between the first and second jarring assemblies.

The jarring apparatus may comprise a locking system for selectively axially fixing and releasing the first lifting structure relative to its associated jarring assembly. The locking system may be operated by relative rotational movement between the first and second jarring assemblies. Operating the first and second lifting structures and also the locking system by the relative rotation between the first and second jarring assemblies may facilitate simplified establishing of appropriate sequencing or timing of the lifting and dropping phases and the fixing and releasing of the first lifting structure.

In this respect, a common datum of the relative positioning of the first and second jarring assemblies may be utilised.

In some examples the locking system may be operable in response to relative axial displacement of the first and second lifting structures, wherein said relative axial displacement is provided in response to relative rotation between the lifting structures.

The locking system may comprise a mechanical locking system for mechanically locking and releasing the first lifting structure relative to its associated jarring assembly. The mechanical locking system may comprise a mechanical latch or the like.

The locking system may comprise a hydraulic locking system for hydraulically locking and releasing the first lifting structure relative to its associated jarring assembly. The hydraulic locking system may be interposed, for example radially interposed, between the first and second jarring assemblies.

The hydraulic locking system, when locked, may hydraulically lock or trap a volume of hydraulic fluid (e.g., incompressible) axially against the first lifting structure. In one example the hydraulic locking system may hydraulically lock or trap a volume of fluid axially between the first lifting structure and one of the first and second lifting assemblies. The hydraulic locking system may hydraulically lock or trap a volume of fluid axially between the first lifting structure and its associated lifting assembly. Accordingly, axial forces may be transmitted between the first lifting structure and its associated jarring assembly via the hydraulically locked fluid.

The hydraulic locking system may release the hydraulically locked fluid to permit axial release of the first lifting structure relative to its associated jarring assembly. Such release of the hydraulic lock may thus permit the first lifting structure to move axially relative to its associated jarring assembly. The hydraulic fluid may be released to a fluid source (e.g., a fluid reservoir, flow path through the jarring apparatus etc.). The hydraulic fluid may be pressure relieved, for example pressure balanced, relative to the fluid source.

Selective trapping and release of the hydraulic fluid may be achieved in accordance with relative rotation between the first and second jarring assemblies.

The hydraulic locking system may comprise a first hydraulic chamber, wherein hydraulic fluid may be hydraulically locked within said first hydraulic chamber to hydraulically lock the first lifting structure relative to the second jarring assembly. The first hydraulic chamber may be at least partially defined between, for example axially between, the first lifting structure and its associated jarring assembly. The first hydraulic chamber may be at least partially defined between, for example radially between, the first and second jarring assemblies. At least a portion of the first hydraulic chamber may be generally annular in form. For example, at least a portion of the first hydraulic chamber may be defined in an annular space between the first and second jarring assemblies.

The hydraulic locking system may comprise a valve assembly which is closed to hydraulically lock the fluid within the first hydraulic chamber, and which is opened to release the hydraulically locked fluid. The valve assembly may be configurable between open and closed configurations in response to relative rotation between the first and second jarring assemblies. Such hydraulic locking and unlocking by the valve assembly may be cyclical in accordance with relative rotation between the first and second jarring assemblies. In some examples the frequency of opening and closing of the valve assembly may be linked to the frequency of jarring.

The first hydraulic chamber may extend between the first lifting structure and the valve assembly. When the valve assembly is in its closed position the fluid within the first hydraulic chamber may become trapped therein, thus hydraulically locking the first lifting structure relative to its associated jarring assembly.

The jarring apparatus may comprise a biasing arrangement within the first hydraulic chamber which acts against, directly or indirectly, the first lifting structure. Such an arrangement may function to bias the first lifting structure towards the second lifting structure. Such a bias may facilitate or provide appropriate force to drive or hold the first and second lifting structures together during the dropping phase. Such a bias may function to assist in re-setting the apparatus (i.e., to drive the dropping phase).

The valve assembly may be configured to open and close communication (e.g., fluid and/or pressure communication) between the first hydraulic chamber and a fluid source to provide hydraulic locking and release of the first lifting structure.

The hydraulic locking system may comprise a second hydraulic chamber which defines the fluid source. In this example the valve assembly may be interposed between the first and second hydraulic chambers such that when the valve assembly is closed the first and second chambers may be isolated from each other (to provide the hydraulic lock), and when the valve assembly is open the first and second chambers may be presented in communication with each other (to release the hydraulic lock).

The second hydraulic chamber may define a hydraulic reservoir, facilitating flow of hydraulic fluid to/from the first hydraulic chamber when the valve assembly is opened. Such flow to/from the first hydraulic chamber may be in accordance with the lifting and dropping phases of the first and second lifting structures. That is, when the valve assembly is opened and the first and second lifting structures are in their lifting phase, hydraulic fluid may be displaced from the first fluid chamber to the second fluid chamber, and when the first and second lifting structures are in their dropping phase hydraulic fluid may move from the second fluid chamber to the first fluid chamber in preparation to provide a hydraulic lock for a subsequent lifting phase when the valve assembly is closed.

In one example the second hydraulic chamber may be defined by a flow path within the jarring apparatus. As such, the second hydraulic chamber may not be defined by a closed space. In this example hydraulic fluid for use in the hydraulic locking system may be obtained from fluid flowing within the jarring apparatus. The fluid flowing within the jarring apparatus may be provided exclusively for use within the hydraulic locking apparatus, for example exclusively as the hydraulic locking fluid. Alternatively, the fluid flowing through the jarring apparatus may provide a separate or additional function, for example associated with wellbore operations, such as drilling or the like. In some examples the fluid may comprise drilling fluid, drilling mud, hydraulic oil, water or the like.

The flow path may extend through the jarring apparatus, for example axially through the jarring apparatus. The flow path may define at least one port to permit communication with the first fluid chamber in accordance with the configuration of the valve assembly. In some examples the at least one port may form part of the valve assembly.

In one example the second hydraulic chamber may be defined by a flow path extending through the first jarring assembly, for example through a mandrel of the first jarring assembly.

The second hydraulic chamber may be provided within a space defined within the jarring apparatus. In one example the second hydraulic chamber may extend between the valve assembly and a moveable barrier. The moveable barrier may permit the volume of the second hydraulic chamber to be varied in accordance with the flow of hydraulic fluid into and from the second hydraulic chamber when the valve assembly is opened. The moveable barrier may comprise a floating piston member. The moveable barrier member may comprise a flexible membrane.

In some examples the moveable barrier may absorb or dampen hydraulic shock loading when the hydraulically locked fluid is released upon the valve assembly becoming opened. The moveable barrier may function to accommodate thermal expansion and contraction of the fluid.

The moveable barrier member may be biased in a direction to reduce the volume of the second hydraulic chamber. Such an arrangement may seek to displace hydraulic fluid from the second fluid chamber into the first fluid chamber when the valve assembly is open. Such an arrangement may function to bias the first lifting structure towards the first lifting structure when the first lifting structure is axially released relative to its associated jarring assembly (i.e., when the valve assembly is open). Such a bias may facilitate or provide appropriate force to drive or hold the first and second lifting structures together during the dropping phase. Such a bias may function to assist in re-setting the apparatus (i.e., to drive the dropping phase).

The moveable barrier member may be spring biased.

An opposing side of the moveable barrier (i.e., opposing to the side exposed to the second hydraulic chamber) may be exposed to ambient pressure, such that said ambient pressure may act to bias the moveable barrier in a direction to reduce the volume of the second hydraulic chamber. The opposing side of the moveable barrier may be directly exposed to ambient fluid, and thus ambient pressure. Alternatively, the opposing side of the moveable barrier may be exposed to a clean fluid, wherein a pressure transfer arrangement is provided to transfer pressure between ambient fluid and the clean fluid. Such an arrangement may minimise the possibility of the apparatus being compromised by debris etc. within ambient fluid. The opposing side of the moveable barrier may be exposed to pressure within the apparatus.

In some examples the first lifting structure may be exposed to ambient pressure. Exposing the moveable barrier and the second lifting structure to a common ambient pressure may function to provide a pressure balance within the apparatus. This may assist to ensure the dropping phase is achieved and suitable resetting between the lifting structures is provided. The first lifting structure may be directly exposed to ambient fluid, and thus ambient pressure. Alternatively, the first lifting structure may be exposed to a clean fluid, wherein a pressure transfer arrangement is provided to transfer pressure between ambient fluid and the clean fluid. The first lifting structure may be exposed to pressure within the apparatus.

The valve assembly may comprise a first valve portion rotatably fixed to one of the first and second jarring assemblies and a second valve portion rotatably fixed relative to the other of the first and second jarring assemblies such that relative rotation between the first and second jarring assemblies causes corresponding relative rotation between the first and second valve portions.

At least one of the first and second valve portions may be provided as part of, for example an integral part of, their associated jarring assembly.

At least one of the first and second valve portions may be separately formed and rotatably fixed relative to their associated jarring assembly by any suitable connection, such as a splined connection, keyed connection, castellated connection and/or the like.

One of the first and second valve portions may be coupled to (e.g., via a suitable connection, by integrally forming or the like) the first lifting structure, thus permitting said first lifting structure to be rotatably coupled to its associated assembly via the a valve portion.

The first and second valve portions may be engaged with each other. The first and second valve portions may be configured for sliding engagement during relative rotation therebetween. In some examples the first and second valve portions may be axially engaged with each other, for example via axially engaging faces. In some examples the first and second valve portions may be radially or circumferentially engaged with each other, for example via radial (e.g., circumferential) surfaces.

In some examples the first and second valve portions may be biased, for example axially biased into engagement with each other, for example via a spring biasing arrangement.

The first and second valve portions may each comprise at least one port, wherein the ports are sequentially aligned and misaligned during relative rotation between the first and second valve portions to sequentially establish and prevent fluid communication between the first and second hydraulic chambers. The at least one port of each valve portion may be provided on or in a respective axial surface of the associated valve portion. The at least one port of each valve portion may be provided on or in a respective circumferential surface of the associated valve portion.

The valve assembly may define a rotary gate valve. The valve assembly may define a rotary plug valve.

In some examples the number of ports in each valve portion may be linked to the jarring frequency of the apparatus in use.

The timing of the alignment and misalignment of the ports may be related to the required timing of the axial release of the first lifting structure and the lifting and dropping phases of the first and second lifting structures. The initial relative rotational position of the first and second valve portions may dictate the timing of opening and closing of the valve assembly.

The ports may define a geometry or profile which facilitates a preferred increase of flow area therethrough during the course of being aligned. In some examples each port may define a leading portion defining a tapering profile, which increases during rotational alignment of respective ports. Such a tapering profile may facilitate a gradual increase in flow area, which may provide benefits such as minimising or damping shock loading upon initial release of the hydraulically locked fluid.

In some examples each port may be profiled to rapidly increase flow area. This may provide benefits, such as avoiding fluid dampening and increase fluid flow to allow as high an impact as possible.

The first and second valve portions may be configured to provide complete sealing therebetween when the ports are misaligned. However, in some examples some degree of leakage may be tolerated. Such leakage may function to lubricate engaging surfaces of the first and second valve portions.

In some examples the hydraulic locking system may comprise a pressure relief system, such as a pressure relief valve, to prevent pressure therein from exceeding a threshold. Such an arrangement may minimise the risk of damage within the apparatus in the event of excessive application of bias between the first and second jarring assemblies.

In one example the first lifting structure may be coupled to its associated jarring assembly via a rotary coupling which permits relative axial movement therebetween. In such an arrangement the first lifting structure may remain rotatably coupled relative to its associated jarring assembly when the first lifting structure is axially released relative to the second jarring assembly. In one example a castellated connection may be provided between the first lifting structure and its associated jarring assembly. As noted above, in one example the first lifting structure may be rotatably coupled to its associated jarring assembly via a valve portion of a valve assembly.

One of the first and second jarring assemblies may comprise a mandrel, and the other of the first and second jarring assemblies may comprise a housing assembly. The mandrel may extend at least partially within the housing assembly. The mandrel may be composed of a unitary or multiple components. Similarly, the housing assembly may be composed of unitary or multiple components.

The first and second jarring assemblies may be rotatably fixed relative to each other when configured in a first mode of operation. Such a first mode of operation may be defined as a deactivated or non-jarring mode of operation. The first and second jarring assemblies may be rotatable relative to each other when configured in a second mode of operation. Such a second mode of operation may be defined as a jarring mode of operation.

When the first and second jarring assemblies are configured in the first (non-jarring) mode of operation torque may be transmitted therebetween. This may facilitate certain operations, such as drilling operations and the like. For example, in a downhole drilling application torque may be transmitted between the first and second jarring assemblies from a drill or work string coupled on one side of the jarring apparatus to a BHA coupled on an opposite side of the jarring apparatus.

The jarring assemblies may be reconfigured between the first and second modes of operation by relative axial movement therebetween. In one example, the jarring assemblies may be reconfigured from the first mode of operation to the second mode of operation by relative axial movement therebetween in a direction from their first axial configuration towards their second axial configuration.

The apparatus may comprise a releasable axial locking mechanism arranged between the first and second jarring assemblies. The releasable axial locking mechanism may be released when the first and second jarring assemblies are, or are to be, configured in the second (jarring) mode of operation, and locked when the first and second jarring assemblies are configured in the first (non-jarring) mode of operation.

The releasable axial locking mechanism may be releasable upon application of a predetermined axial force applied between the first and second jarring assemblies. The predetermined axial force may be non-zero.

The releasable axial locking mechanism may be resettable.

The releasable axial locking mechanism may comprise a mechanical locking mechanism. The releasable axial locking mechanism may comprise a fluid locking system, such as hydraulic locking mechanism.

The apparatus may comprise a rotatable locking mechanism arranged between the first and second jarring assemblies for rotatably locking the first and second jarring assemblies when configured in the first (non-jarring) mode of operation. The rotatable locking mechanism may be releasable to permit the first and second jarring assemblies to be configured in the second (jarring) mode of operation. The rotatable locking mechanism may be resettable to permit reconfiguration of the first and second jarring assemblies to the first (non-jarring) mode of operation. The rotatable mechanism may be releasable and resettable by providing relative axial movement between the first and second jarring assemblies.

The rotatable locking mechanism may comprise, for example, a spline arrangement, key arrangement and/or the like.

In some examples the jarring apparatus may be for use within a wellbore. As such, the jarring apparatus may define a downhole jarring apparatus. The jarring apparatus may be configured to apply a jarring force to a pipe string, downhole tool, bottom hole assembly (BHA), such as a drilling BHA, or the like. The jarring apparatus may be configured for use in releasing an object which is stuck within a wellbore. In some examples the jarring apparatus may be deployable downhole on an elongate medium, such as wireline, coiled tubing, jointed tubing or the like. The jarring apparatus may be tractor deployed downhole.

The jarring apparatus may be configured for use in pulling plugs within a wellbore or associated infrastructure.

The jarring apparatus may be configured for use in pulling or retrieval operations associated with removal of infrastructure from a wellbore, such as fishing operations, pulling completions, casing, liner, conductor and the like.

The jarring apparatus may be configured for use in subsea applications, such as in piling applications, equipment removal applications, and the like.

In some applications the jarring apparatus may be required to support load, for example significant load therethrough. For example, in a casing pulling operation the jarring apparatus may be directly or indirectly coupled to a casing string being pulled, which might generate loading, for example significant loading through the jarring apparatus of up to and beyond 4.5 MN. The provision of the thrust assembly within the jarring apparatus may effectively accommodate this loading, without this becoming applied within the lifting assembly, or indeed other load sensitive components.

The apparatus may be configured to permit axial jarring in one axial direction, such as in an upward or downward direction. The apparatus may be configured to permit axial jarring in opposing axial directions, such as both upwardly and downwardly.

Relative rotation between the first and second jarring assemblies to provide jarring may be achieved via a rotational drive mechanism. The rotational drive mechanism may be configured separately from the apparatus. Alternatively, or additionally, the apparatus may comprise a rotational drive mechanism.

The rotational drive mechanism may be coupled or otherwise associated with at least one of the first and second jarring assemblies and configured to provide a relative rotational movement therebetween.

The rotational drive mechanism may comprise a rotatable work string coupled to at least one of the first and second jarring assemblies. The work string may be defined by, for example, a drilling string.

The rotational drive mechanism may comprise a motor, such as an electric motor, pneumatic motor, hydraulic motor, mud motor or the like.

An aspect of the present disclosure relates to a method for providing jarring, comprising:

establishing relative axial movement between first and second jarring assemblies of a jarring apparatus from a first axial configuration towards a second axial configuration;

limiting relative axial movement between the first and second jarring assemblies at the second axial configuration by a thrust assembly; and establishing relative rotational movement between the first and second jarring assemblies to move a jarring mass in reverse first and second directions.

An aspect of the present disclosure relates to a method for providing jarring, comprising:

establishing relative axial movement between first and second jarring assemblies of a jarring apparatus from a first axial configuration towards a second axial configuration to energise a force mechanism which functions to bias a jarring mass in a first axial direction;

limiting relative axial movement between the first and second jarring assemblies at the second axial configuration by a thrust assembly; and establishing relative rotational movement between the first and second jarring assemblies to operate a lifting assembly within the jarring apparatus which cyclically lifts the jarring mass in a second axial direction against the bias of the force mechanism and releases the lifted jarring mass to permit the jarring mass to be driven by the force mechanism in the first direction to generate a jarring force within the apparatus.

Limiting the relative axial movement between the first and second jarring assemblies by use of the thrust assembly minimise risk of overloading at least the lifting assembly.

The method may be performed using a jarring apparatus according to any other aspect.

It should be understood that the features defined in relation to one aspect may be applied in relation to any other aspect.

BRIEF DESCRIPTION OF THE DRAWINGS

These and other aspects of the present disclosure will now be described, by way of example only, with reference to the accompanying drawings, in which:

FIG. 8 is an exploded view of a rotary connection between a jarring mass of the apparatus of FIG. 7A and an outer housing;

FIGS. 9 and 10 illustrate separate lifting structures of a lifting assembly of the apparatus of FIG. 7A;

FIGS. 11A to 11D illustrate a rotary sequence of cooperation between the separate lifting structures of the lifting assembly;

DETAILED DESCRIPTION OF THE DRAWINGS

Aspects of the present disclosure relate to a jarring apparatus. Such a jarring apparatus may be used in any application which requires the application of a jarring force, extending from downhole applications, subsea applications, topside applications and the like. For the purposes of the present exemplary description a jarring apparatus for use within a wellbore is described. However, this is not limiting, and the principles of the present disclosure may be applied in any jarring application, which may or may not be utilised in a wellbore.

Figure 3A:
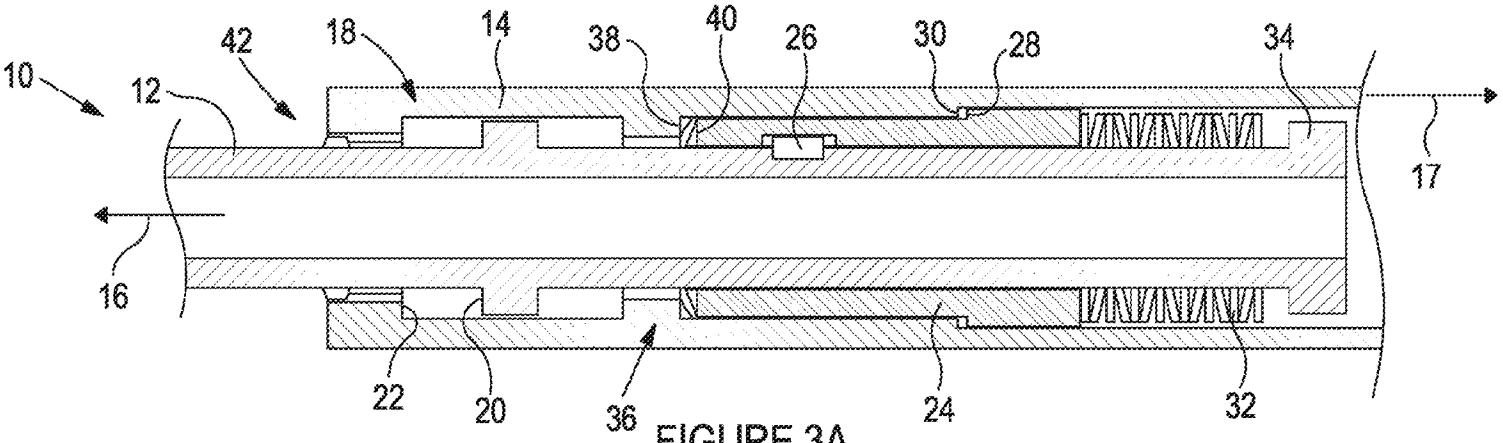
FIGS. 3A and 3B diagrammatically illustrate a jarring apparatus in accordance with the present disclosure in different operational configurations.

A jarring apparatus, generally identified by reference numeral 10, is diagrammatically illustrated in cross-section in FIG. 3A. The jarring apparatus 10, which is only partially shown in FIG. 3A, is illustrated in a non-jarring configuration and is sized and arranged to be deployed into a wellbore. Although not shown, the jarring apparatus 10 may be deployed into a wellbore on wireline, tubing, such as coiled tubing, jointed pipe or the like.

The jarring apparatus 10 comprises a first jarring assembly in the form of a mandrel 12, and a second jarring assembly in the form of an outer housing assembly 14. The jarring apparatus 10 is configured such that relative rotation established between the mandrel 12 and outer housing assembly 14 causes reciprocating motion of a jarring mass 24 to generate repeated linear jarring forces. In this regard, as jarring is achieved through relative rotation, the apparatus 10 may be defined as a rotary jarring apparatus. In use, the outer housing assembly 14 may be engaged with an object (not shown), such as a stuck object within a wellbore, with the mandrel 12 rotated via a suitable rotary drive, such as a motor, rotatable work string or the like, thus applying the generated jarring forces to the object.

In the present example the jarring apparatus 10 is arranged to provide axial jarring forces in the direction of arrow 16, which may be defined as an uphole direction. In use, an axial pulling force may be applied to the mandrel 12 in the direction of arrow 16 during the jarring operation, and a load/resistance applied to the housing in the direction of arrow 17, such as from a stuck object, suspended load etc. Such loading through the apparatus 10 may contribute to the generation of a jarring force. However, in the present example the jarring apparatus 10 incorporates features to provide a degree of protection from excessive loading or overloading.

The mandrel 12 includes a tubular structure which extends into the outer housing assembly 14. A first or upper end of the mandrel 12 may include a suitable connector (not shown) for facilitating connection with a suitable deployment or drive structure, such as a work string (e.g., drill pipe). The mandrel 12 may be provided as a unitary component, or may be composed of multiple connected components. Similarly, the housing assembly 14 may be provided as a unitary component, or may be composed of multiple connected components.

The apparatus 10 further comprises a thrust assembly 18 interposed between the mandrel 12 and housing 14. In the illustrated example the thrust assembly 18 includes a first thrust shoulder 20 provided on the mandrel 12, and a second thrust shoulder 22 provided on the housing 14. In the configuration shown in FIG. 3A the first and second thrust shoulders 20, 22 are axially separated and thus disengaged. However, as will be described in more detail below, relative axial movement between the mandrel 12 and housing 14 (in the relative direction of arrows 16, 17) will eventually bring the first and second thrust shoulders 20, 22 into engagement, such that axial loading (in the relative direction of arrows 16, 17) may be transmitted between the mandrel and 12 and housing 14 via the thrust assembly 18, thus diverting such loading from other components within the apparatus 10. In this respect the thrust assembly may function or define a load limiter. The thrust assembly 18 permits rotation between the first and second thrust shoulders 20, 22 when engaged, such that the thrust assembly 18 may function as a thrust bearing.

The jarring mass 24 is radially positioned between the mandrel 12 and housing 14, and is axially moveable in reverse directions (directions 16, 17) relative to both the mandrel 12 and housing 14. The jarring mass 24 is rotatably fixed relative to the mandrel 12 via a rotary connection 26, such as a keyed or splined connection. However, in other examples the jarring mass may alternatively be rotatably fixed relative to the housing 14.

The jarring mass 24 includes a first impact surface 28, and the housing 14 includes a second impact surface 30, wherein, in use, reciprocating axial movement of the jarring mass 24 causes the first and second impact surfaces 28, 30 to axially impact together, thus generating repeated axial jarring forces within the apparatus 10. In an alternative example the mandrel 12 may comprise an axial impact surface, alternative or in addition to the impact surface provided on the housing 14. As the jarring mass 24 is responsible for generating impact within the apparatus 10, the jarring mass may thus also be defined as a hammer.

A force mechanism 32 in the form of a power spring (e.g., a Bellville spring stack) is provided within the apparatus 10, and is configured, in use, to bias the jarring mass 24 to move axially in the direction of arrow 16, and thus to bias the first and second impact surfaces 28, 30 into engagement. As will be described in more detail below, relative movement between the mandrel 12 and housing 14 in the direction of arrows 16, 17, will cause the spring 32 to be engaged and compressed by an annular shoulder 34 on the mandrel 12. In this respect, the force generated by the spring 32 against the jarring mass 24 is a function of the compression or displacement of the spring 32. In some examples the spring 32 may be uncompressed until engaged by the mandrel. However, in other examples the spring may carry a degree of pre-compression.

The jarring apparatus 10 further includes a lifting assembly 36 which is operable by relative rotation between the mandrel 12 and housing 14 to cyclically lift the jarring mass 24 in the direction of arrow 17 against the bias of the spring 32, and release the lifted jarring mass 24 to permit the jarring mass to be driven by the spring 32 in the direction of arrow 16, causing the impact surfaces 28, 30 to rapidly engage to establish a jarring force. Any suitable form of lifting assembly 36 may be provided to function to cyclically lift and release the jarring mass 24 in the manner described.

In the present example the lifting assembly 36 includes a first lifting structure 38 rotatably and axially fixed relative to the housing 14, and a second lifting structure 40 rotatably fixed, but axially moveable, relative to the mandrel 12. In the present example the second lifting structure 40 is integrally formed with the jarring mass 24, and is thus rotatably connected to the mandrel 12 via rotatable connection 26. In other examples the second lifting structure 40 may be separately formed and rotatably coupled to the jarring mass 26. In further examples the second lifting structure 40 may be separately rotatably coupled to the mandrel 12. In such examples the jarring mass 24 may not necessarily be rotatably coupled to the mandrel 12.

Figure 2:
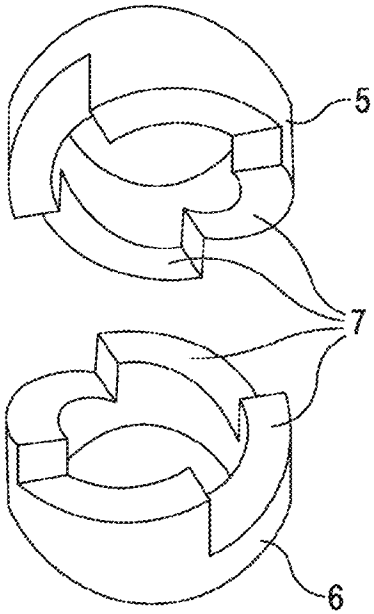
FIGURE 2 (Prior Art)
FIGS. 1 and 2 illustrate a prior art jarring tool.
Figure 1:
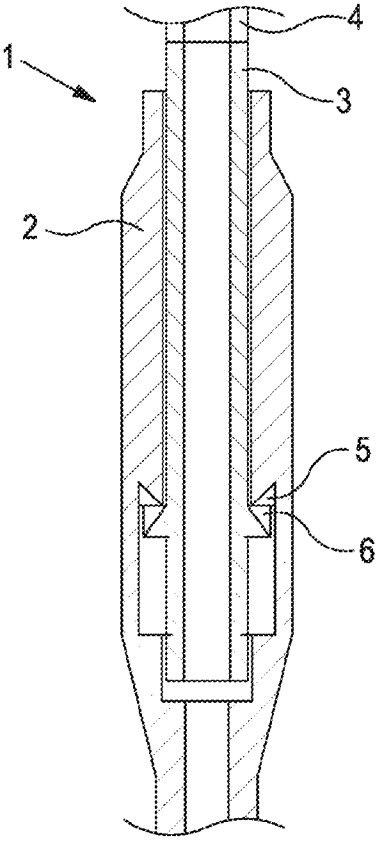
FIGURE 1 (Prior Art)

The lifting structures 38, 40 include cooperating cam structures which cooperate during relative rotation therebetween to cause the second lifting structure 40 to be axially moved in cyclical lifting and dropping phases, thus effecting axial reciprocating movement of the jarring mass 24. The cam structures may be provided as in the example of FIG. 2, or may be provided in accordance with later described examples.

Loading may be applied between the first and second lifting structures 38, 40 which is a function of the biasing force provided by the spring 32. In this respect such loading may be controlled by appropriate selection of the spring 32, by the extent of compression of the spring 32 caused by relative movement between the mandrel 12 and housing 14, and by virtue of the load limiting effect of the thrust assembly 18, which will be described in more detail below. This may assist to increase the longevity of the first and second lifting structures, and thus of the lifting assembly.

The jarring apparatus 10 further includes an optional releasable rotary connection 42 between the mandrel 12 and housing 14. In the present example the releasable rotary connection 42 includes a splined connection. When the apparatus 10 is configured as shown in FIG. 3A, the releasable rotary connection 42 is engaged, and the mandrel 12 and housing 14 are rotatably coupled. Such a configuration may thus prevent any jarring to occur, to the extent that this configuration may be defined as a non-jarring configuration. Further, the rotary connection may allow torque to be transmitted between the mandrel 12 and housing 14, which may be useful or required in many applications, such as in drilling applications and the like.

Figure 3B:
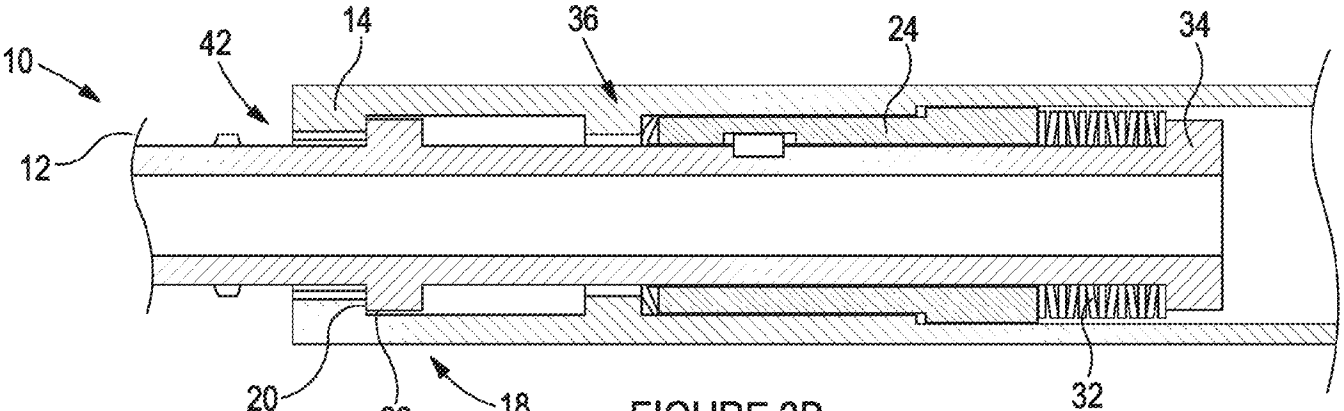

When jarring is to be performed, the mandrel 12 and housing 14 are axially moved relative to each other (in the relative direction of arrows 16, 17) to disengage the rotary connection 42, as illustrated in FIG. 3B, thus permitting relative rotational movement to be achieved to operate the lifting assembly 36 and lift/drop the jarring mass 24 to generate jarring. In some applications the housing 14 may be held stationary, such that the relative movement is achieved by moving, for example pulling, and rotating the mandrel 12. Such axial movement, in addition to releasing the rotary connection 42, causes the annular shoulder 34 of the mandrel 12 to pick up and energise the spring 32, thus establishing the bias force acting against the jarring mass 24 in the direction of arrow 16.

Although not shown, the apparatus may further comprise a releasable axial connection between the mandrel 12 and housing 14 which first needs to be disengaged to allow the relative axial movement. Such a releasable axial connection may be releasable upon application of a threshold release force applied between the mandrel 12 and housing 14.

In the configuration of FIG. 3B the mandrel 12 has been moved until the thrust assembly 18 is engaged, such that further axial loading applied between the mandrel 12 and housing (e.g., by increasing an overpull on the mandrel 12) will be transmitted via the thrust assembly 18 and thus diverted from the spring 32 and the lifting assembly 36. In this configuration the spring 32 may be considered to provide its maximum bias force, subject to any minor variation caused by the cyclical lifting of the jarring mass 24 by the lifting assembly 36, which will be described further below.

While FIG. 3B illustrates the thrust assembly 18 fully engaged, it should be understood that jarring may be effected at any stage following release of the rotary connection 42 and energising of the spring 32. In this respect, the extent of axial loading applied between the mandrel 12 and housing 14, prior to engagement of the thrust assembly 18, will dictate the level of bias force developed by the spring 32 and thus the level of jarring forces created within the apparatus 10. In this respect, a user may control the jarring force output by controlling the overpull on the mandrel 12, up until the load limit has been reached via engagement of the thrust assembly 18. This can provide a significant degree of operational flexibility within the apparatus 10, while minimising risk of overloading.

Figure 4:
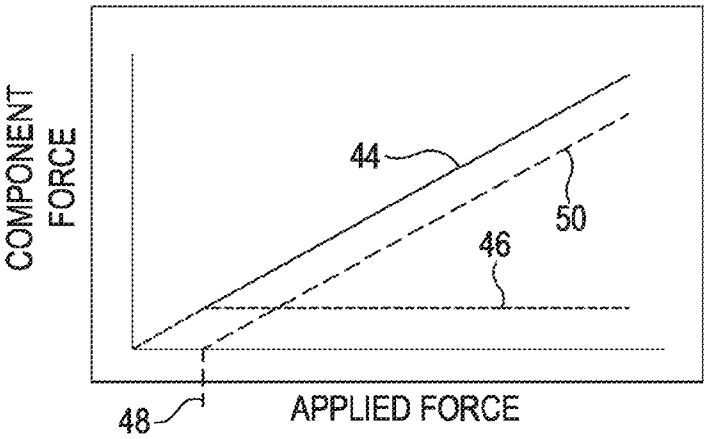
FIGS. 4 to 6 provide graphical illustrations of different parameters associated with the jarring apparatus of FIG. 3 when in use.

The effect of the load protection within the apparatus 10 is graphically shown in FIG. 4, which illustrates the forces experienced within components of the apparatus 10 during increasing load applied therethrough. In this example line 44 represents the total loading applied through the apparatus 10, while line 46 illustrates the loading generated between the first and second lifting structures 38, 40 of the lifting assembly 36. During initial stages of loading, and assuming the spring 32 has been energised, loading within the lifting assembly 38 increases in accordance with the total loading applied through the apparatus 10, until point 48 when the thrust assembly 18 is engaged. Once the thrust assembly 18 is engaged, the loading within the lifting assembly 36 will remain constant at the illustrated maximum value, with the thrust assembly 18 picking up any increasing load applied, illustrated by line 50.

Figure 5:
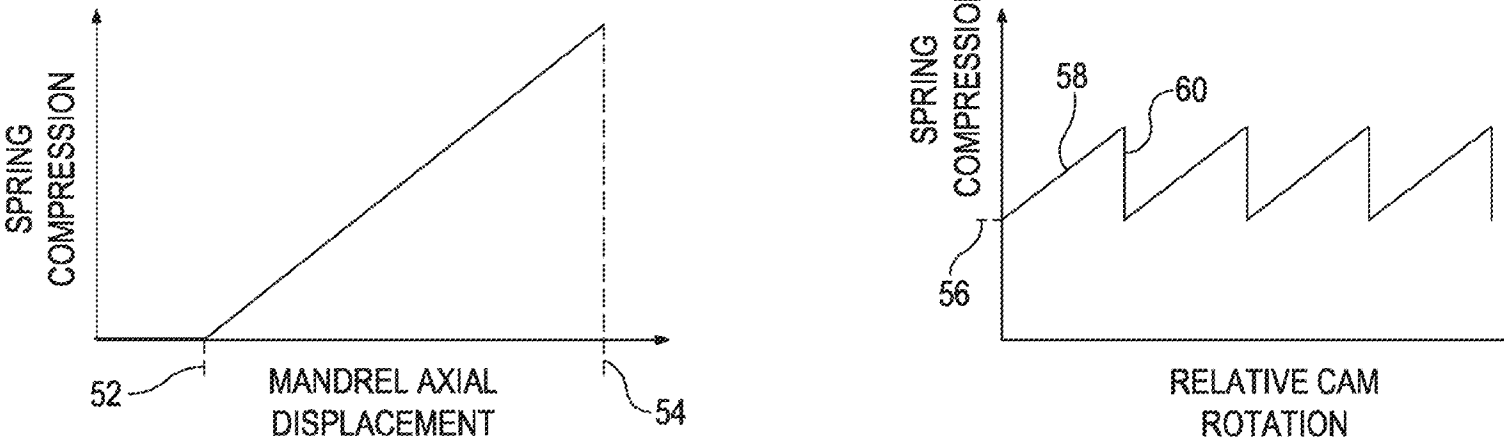

FIG. 5 graphically illustrates the effect of the compression of the spring 32 by axial movement of the mandrel 12 in the direction of arrow 16. In this case, the spring 32 remains in its initial uncompressed state (or initial pre-compressed state) until engaged by the mandrel 12, illustrated by point 52 in FIG. 5. Further axial displacement of the mandrel 12 causes the spring to be compressed up until point 54 is reached, which coincides with the engagement of the thrust assembly 18.

Figure 6:
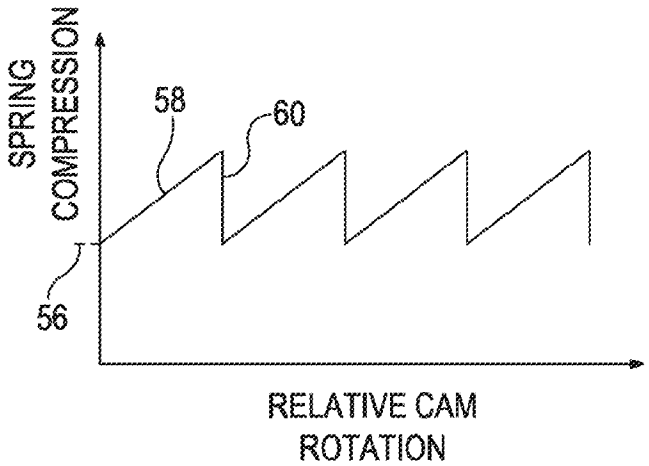

FIG. 6 graphically illustrates the effect of the operation of the lifting assembly 36 on compression of the spring 32. The initial compression of the spring 32 is represented at point 56, which will be the compression caused by the displacement of the mandrel 12 at any point in time. That is, the graphical representation of FIG. 6 is intended to illustrate operation at an initial spring compression at any stage up to engagement of the thrust assembly 18. As such, the scale in FIGS. 5 and 6 may be different. During relative rotation within the lifting assembly 36 the spring 32 is further compressed during lifting of the jarring mass 24, illustrated by line 58, and then rapidly relieved, illustrated by line 60, which drives the jarring mass 24 to impact. In some examples the extent of additional compression caused by the lifting assembly 36 may be considered negligible in terms of increasing the bias force of the spring 32.

Figure 7A:
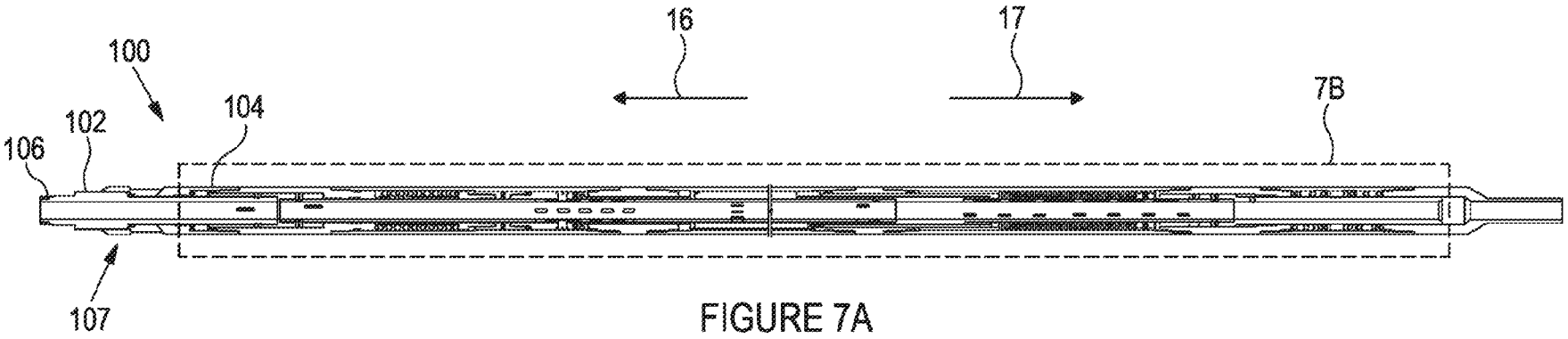
FIG. 7A is a cross-sectional view of a jarring apparatus according to the present disclosure.

Another example of a jarring apparatus, in this case represented by reference numeral 100, is illustrated in FIG. 7A in cross-section, which is similar in many respects to apparatus 10 first shown in FIG. 3A. The apparatus 100 is sized and arranged to be deployed in a wellbore, for example on wireline, tubing etc. However, the jarring apparatus 100 may be used in any application requiring application of jarring, including operations outside of a wellbore.

The apparatus 100 comprises a first jarring assembly in the form of a mandrel 102, and a second jarring assembly in the form of a housing assembly 104. The mandrel 102 and housing assembly 104 in the present example are each composed of multiple connected components. As in the previous example, the apparatus 100 is configured such that relative rotation established between the mandrel 102 and housing 104 causes repeated jarring forces to be generated, and as such the apparatus 100 may also be defined as a rotary jarring apparatus. In use, the outer housing assembly 104 may be engaged with an object (not shown), such as a stuck object, suspended object etc., with the mandrel rotated via a suitable rotary drive, such as a motor, rotatable work string or the like, thus applying the generated jarring forces to the object.

In the present example the jarring apparatus 100 is arranged to provide axial jarring forces in the direction of arrow 16, which may be defined as an uphole direction. As such, the jarring may be defined as upjarring. An axial pulling force may be applied to the mandrel 102 in the direction of arrow 16 during the jarring operation. As in the previously described example, such loading through the apparatus 100 may contribute to the generation of a jarring force, and the jarring apparatus 100 incorporates features to provide a degree of protection from excessive loading or overloading.

As will be described below in more detail, axial jarring in an opposite (e.g., downhole) direction, illustrated by arrow 17, may also be possible, with an optional axial pushing force applied to the mandrel in the direction of arrow 17.

The mandrel 102 includes a tubular structure which extends into the outer housing assembly 104. A first or upper end of the mandrel 102 includes a suitable connector 106 for facilitating connection with a suitable deployment or drive structure, such as a work string (not shown). A releasable rotary connection 107 is provided between the mandrel 102 and housing 104. In the present example the releasable rotary connection 107 includes a splined connection, and when the apparatus 100 is configured as shown in FIG. 7A, the releasable rotary connection 107 is engaged, and the mandrel 102 and housing 104 are rotatably coupled. Such a configuration may thus prevent any jarring to occur, to the extent that this configuration may be defined as a non-jarring configuration. Further, the rotary connection may allow torque to be transmitted between the mandrel 102 and housing 104, which may be useful or required in many applications, such as in drilling applications and the like. When jarring is required, axial movement between the mandrel 102 and housing 104 in the relative direction of arrows 16, 17 will cause the rotary connection 107 to be disengaged.

Figure 7B:
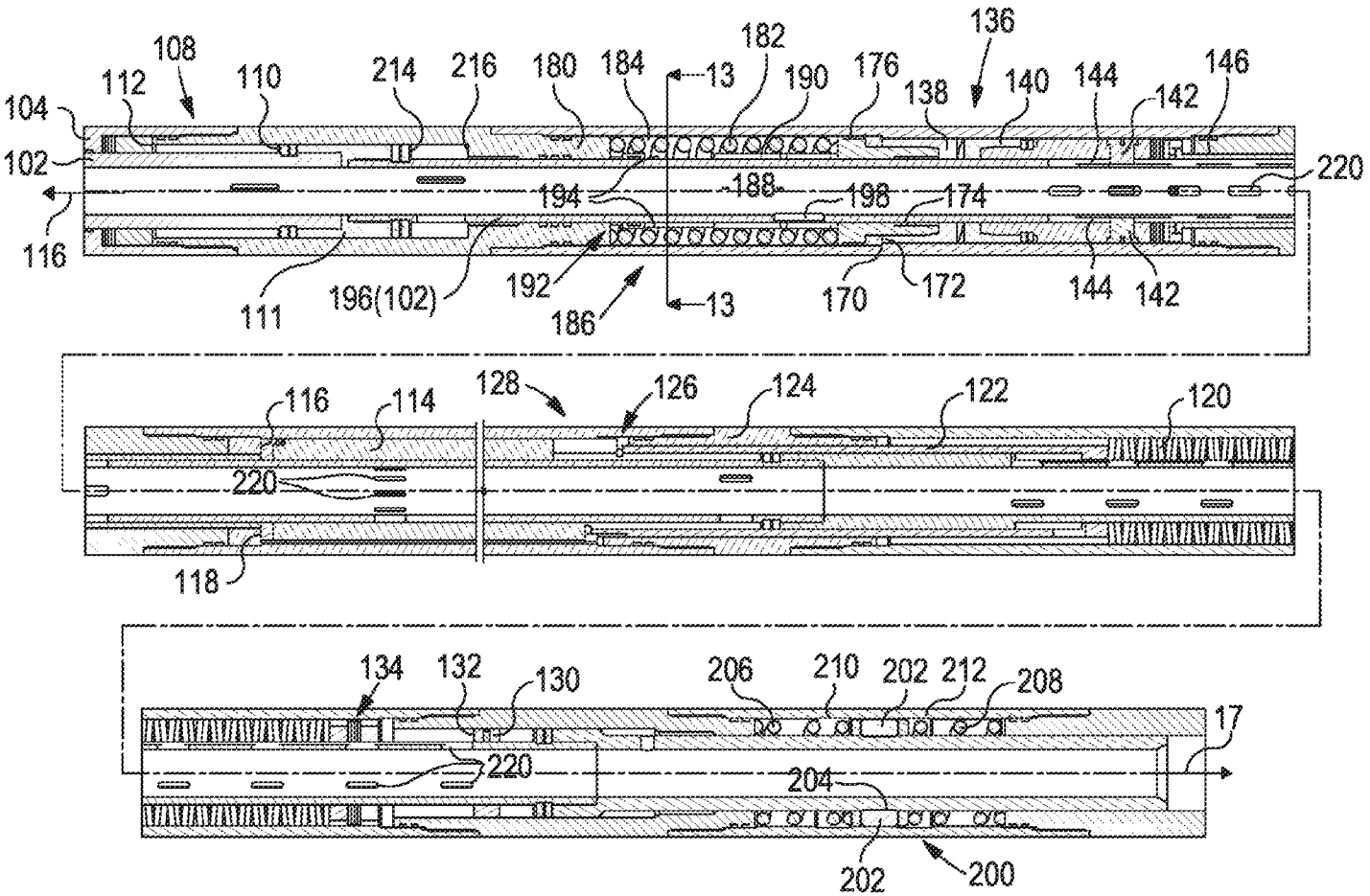
FIG. 7B is an enlarged split view of the portion of the apparatus of FIG. 7A contained within the broken outline.

To aid the current description an enlarged split view of the jarring apparatus 100 in region 7B of FIG. 7A is illustrated in FIG. 7B, reference to which is now made.

As in the previously described example, the apparatus 100 includes a thrust assembly (or thrust bearing) 108 interposed between the mandrel 102 and housing 104. In the illustrated example the thrust assembly 108 includes a first thrust shoulder 110 provided on the mandrel 102, and a second thrust shoulder 112 provided on the housing 104. The first thrust shoulder 110 is provided on a coupling 111 which provides a connection between separate mandrel components. As will be described in further detail below, the coupling 111 also includes an impact surface 214 which is configured to impact against a matching impact surface 216 on the housing 104 to provide a secondary linear impact function within the apparatus 100.

In the configuration shown in FIG. 7B the first and second thrust shoulders 110, 112 are axially separated and thus disengaged. However, as will be described in more detail below, relative axial movement between the mandrel 102 and housing 104 (in the relative direction of arrows 16, 17) will eventually bring the first and second thrust shoulders 110, 112 into engagement, such that axial loading (in the relative direction of arrows 16, 17) may be transmitted between the mandrel 102 and housing 104 via the thrust assembly 108, thus diverting such loading from other components within the apparatus 100. In this respect the thrust assembly may function as or define a load limiter.

The apparatus 100 further comprises a jarring mass 114 radially positioned between the mandrel 102 and housing 104, and being axially moveable in reverse directions (directions 16, 17) relative to both the mandrel 12 and housing 14. The jarring mass 114 may be of any required length, for example in accordance with a desired weight to be provided, and in the present example the apparatus 100 is illustrated axially split over the length of the jarring mass 114 to reflect the non-specific length requirement of the mass 114.

The jarring mass 114 includes a first impact surface 116 (provided on an impact insert), and the housing 104 includes a second impact surface 118 (also provided on an impact insert), wherein, in use, reciprocating axial movement of the jarring mass 114 causes the first and second impact surfaces 116, 118 to axially impact together, thus generating repeated axial jarring forces within the apparatus 100. In an alternative example the mandrel 102 may comprise an axial impact surface, alternative to or in addition to the impact surface provided on the housing 104. As the jarring mass 114 is responsible for generating the impact within the apparatus 100, the jarring mass may thus also be defined as a hammer.

A force mechanism in the form of a power spring 120 (e.g., a Bellville spring stack) is provided within the apparatus 100, and is configured, in use, to bias the jarring mass 114 to move axially in the direction of arrow 16, and thus to bias the first and second impact surfaces 116, 118 into engagement. A mass pusher sleeve 122 extends between the spring 120 and the jarring mass 114, such that the spring 120 may act indirectly on the jarring mass 114, and vice versa. In the present example the mass pusher sleeve 122 extends past a coupling 124 of the housing 104, and as also shown in the exploded view of FIG. 8, the mass pusher sleeve 122 is rotatably connected to the coupling 124 via a first castellated connection 126, and also to the hammer via a second castellated coupling 128.

The mandrel 102 carries a spring pick-up ring 130 which defines an annular shoulder 132. In the initial configuration of FIG. 7B the mandrel 102 is positioned within the housing 104 such that the annular shoulder 132 is separated from the spring 120. As will be described in more detail below, relative movement between the mandrel 102 and housing 104 in the direction of arrows 16, 17, will cause the annular shoulder 132 to engage and compress the spring 120. In the present example a thrust bearing 134 is interposed between the spring 120 and spring pick-up ring 130, which transmits axial loading while accommodating relative rotation between the spring 120 and the spring pick-up ring 130. The force generated by the spring 120 against the jarring mass 114 (via the pusher sleeve 122) is thus a function of the compression or displacement of the spring 120 caused by movement of the mandrel 102 in the direction of arrow 16. In some examples the spring 120 may be uncompressed until engaged by the mandrel. However, in other examples the spring may carry a degree of pre-compression.

The spring pick-up ring 130 may be adjustably mounted on the mandrel 102, which may allow a user to set the spring pick-up point within the apparatus 100. Furthermore, in some examples the spring pick-up ring 130 may be releasably secured to the mandrel 102, for example via a shear pin connection. Such a releasable connection may permit the spring pick-up ring 130 to be released upon exposure to an over-load condition within the apparatus, thus providing a degree of load protection.

The apparatus 100 further comprises a lifting assembly or mechanism 136 which includes a first lifting cam structure 138 rotatably fixed to the outer housing 104 (in a manner described later), and a second lifting cam structure 140 rotatably fixed relative to the mandrel 102 via keys 142. The keys 142 are engaged within axial key-ways 144 within the mandrel 102 such that relative axial movement is permitted between the second lifting cam structure 140 and the mandrel 102. A cam pusher sleeve 146 extends axially between the second lifting cam structure 140 and the jarring mass 114. As will be described in detail below, relative rotation between the mandrel 102 and housing 104 causes the first and second lifting cam structures 138, 140 to cooperate to cause cyclical lifting and dropping of the second lifting cam structure 140, thus facilitating lifting and dropping of the jarring mass 114 to generate impact between the impact surfaces 116, 118.

Reference is additionally made to FIG. 9 which is a perspective view of the first lifting cam structure 138, and FIG. 10 which is a perspective view of the second lifting cam structure 140. The first lifting cam 138 includes a first rotary cam profile 148 which in the present example includes two circumferentially distributed cam lobes 150 each having a gradual ramp or rising portion 152, and a drop-off or falling portion 154, with a base portion 156 circumferentially positioned between each cam lobe 150. The second lifting cam 140 includes a complimentary second rotary cam profile 158, and thus includes two circumferentially distributed cam lobes 160 each having a gradual ramp or rising portion 162, and a drop-off or falling portion 164, with a base portion 166 circumferentially positioned between each cam lobe 160.

The complementary rotary cam profiles 148, 158 interengage and cooperate upon relative rotation therebetween to cyclically cause the cam structures 138, 140 to be displaced in one axial direction in a lifting phase, and to be displaced in a reverse axial direction in a dropping phase, as illustrated in FIGS. 11A to 11D. In this respect, FIG. 11A illustrates initial engagement of the respective ramp portions 152, 162 at the start of a lifting phase, with relative rotation therebetween permitting the cooperating ramp portions 152, 162 to circumferentially slide relative to each other and axially drive the cam structures 138, 140 apart towards a peak separation, as shown in FIG. 11B. As the cam structures 138, 140 progress towards the illustrated peak position in FIG. 11B the area of contact therebetween reduces, thus causing the stresses induced in the cam structures 138, 140 to increase. As will be described herein, the jarring apparatus 100 provides measures to minimise such stresses within the cam structures 138, 140 thus prolonging their operational life span.

Following completion of this lifting phase the drop-off portions 154, 164 become aligned, allowing the cam structures 138, 140 to "drop" and cause reverse axial displacement in a dropping phase, as illustrated in FIG. 11C. The cam structures 138, 140 are arranged within the jarring apparatus 100 such that at this dropping phase the first and second cam profiles 148, 158 are prevented from axial engagement or impact therebetween. That is, immediately following the dropping phase an axial separation gap 168 is provided between the first and second cam profiles 148, 158. This is achieved, at least in part, in the present example by the provision of a no-go profile in the form of an annular lip 170 provided on the first cam structure 138 which engages a corresponding axial shoulder 172 on the housing 104 (see FIG. 7B). Alternatively, or additionally, a no-go profile may be provided on the second cam structure 140 to provide this function.

Following this dropping phase the cam lobes 150, 160 become aligned with the opposing base portions 156, 166, as illustrated in FIG. 11D, without contact therebetween, as noted above (i.e., the axial separation gap 168 is maintained). Further relative rotation may provide a transition from the completed dropping phase to initiation of a subsequent lifting phase, with the cycle of FIGS. 11A to 11D being repeated, causing cyclically lifting and dropping of the cam structures 138, 140. In the present example, with each cam structure 138, 140 comprising two cam lobes 150, 160, the cams structures 138, 140 will undergo two cycles of lifting and dropping for each full 360 degrees of relative rotation therebetween. The provision of more or less cam lobes 150, 160 on each cam 138, 140 may facilitate more or less cycles for each full 360 degrees of relative rotation.

Loading may be applied between the first and second cam structures 138, 140 which is a function of the biasing force provided by the spring 120. In this respect such loading may be controlled by appropriate selection of the spring 120, by the extent of compression of the spring 120 caused by relative movement between the mandrel 102 and housing 104, and by virtue of the load limiting effect of the thrust assembly 108, which will be described in more detail below. This may assist to increase the longevity of the first and second cam structures 138, 140, and thus of the lifting assembly 136.

Referring again to FIG. 7B, the first cam structure 138 is positioned radially between the mandrel 102 and the housing 104, and is sealed relative to the mandrel 102 via inner seals 174, and sealed relative to the housing 104 via outer seals 176. The first cam structure 138 is rotatably fixed relative to the housing 104, specifically to a coupling portion 180 of the housing 104, which will be described in more detail below. A spring 182 biases the first cam structure 138 towards the second cam structure 140.

The first cam structure 138 is configured to be selectively axially fixed and released relative to the housing 104 via a hydraulic locking system. The hydraulic locking system functions to fix the first cam structure 138 relative to the housing 104 during the lifting phase between the first and second cam structures 138, 140, which thus permits the cooperation of the first and second cam profiles 148, 158 to cause the jarring mass 114 to be lifted in the direction of arrow 17 by the second cam structure 140, against the bias of the spring 120, and thus axially separate the first and second impact surfaces 116, 118. The hydraulic locking system also functions to release the first cam structure 138 relative to the housing 104 prior to completion of the lifting phase between the cam structures 138, 140, with such axial release permitting the spring 120 to drive the jarring mass 114 in the direction of arrow 16 and cause the impact surfaces 116, 118 to be rapidly impacted together, to generate a jarring force.

In the present example, the hydraulic locking system 186 includes a hydraulic chamber 184 which is defined radially between the mandrel 102 and housing 104, and axially between the first cam structure 138 and the coupling portion 180. A valve assembly 186 is provided between the hydraulic chamber 184 and a flow path 188 extending through the mandrel 104, wherein the valve assembly 186 is configurable between open and closed positions by relative rotation between the mandrel 102 and housing 104. When the valve assembly 186 is in its closed position fluid communication between the hydraulic chamber 184 and flow path 188 is prevented, thus hydraulically locking the hydraulic fluid in the hydraulic chamber 184, effectively axially fixing the first cam structure 138 relative to the housing 104. When the valve assembly 186 is in its open position fluid communication between the hydraulic chamber 184 and flow path 188 is permitted, allowing fluid to be displaced from the hydraulic chamber 184, and effectively axially releasing the first cam structure 138 from the housing 104.

Figure 12:
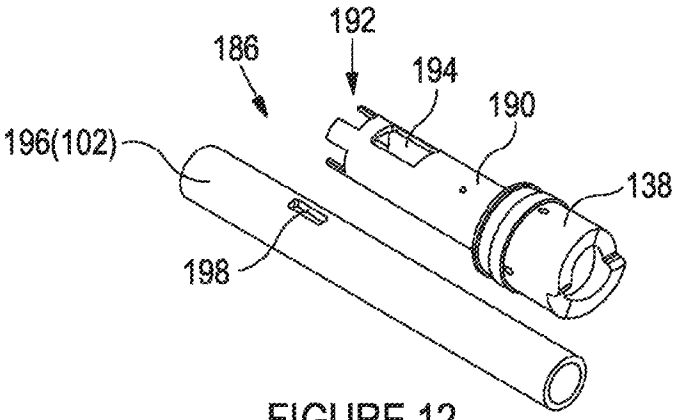
FIG. 12 is an exploded view of a rotary valve of the jarring apparatus of FIG. 7A.

Reference is additionally made to FIG. 12 which is a perspective exploded view of the valve assembly 186 and the first cam structure 138. The valve assembly 186 in the present example is provided in the form of a rotary plug valve and comprises a valve sleeve 190 which is rotatably fixed to the coupling portion 180, and thus to the housing 104, via a castellated coupling 192. In this example the valve sleeve 190 is coupled with the first cam structure 138, and thus provides a rotary connection between the housing 104 and the first cam structure 138. The valve sleeve 190 includes two circumferentially arranged (in this case diametrically opposed) ports 194 extending radially therethrough.

Figure 13A:
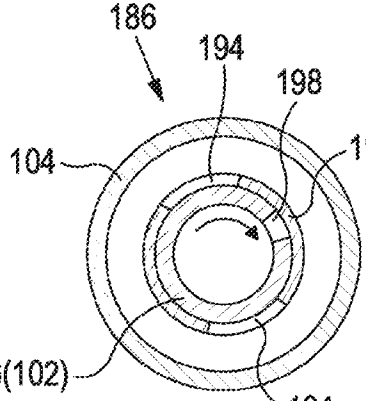
FIGS. 13A to 13D are sectional views through line 13-13 of FIG. 7B, and illustrate sequential stages of operation of the rotary valve.
Figure 13B:
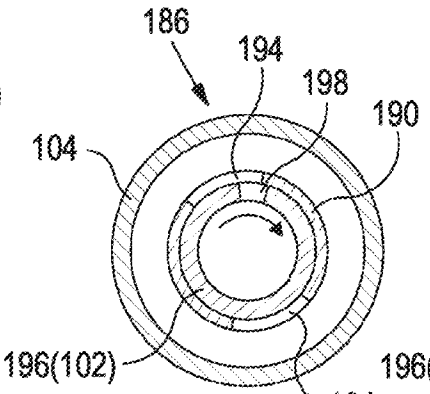
Figure 13C:
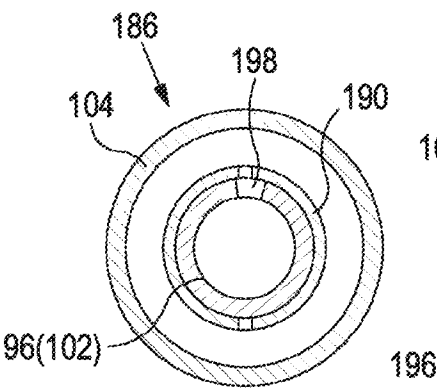
Figure 13D:
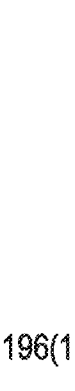

The valve assembly 186 further comprises a valve selector portion 196, which is formed by the mandrel 102, and includes a single port 198 extending radially through the valve selector portion 196 (two diametrically opposed ports could be provided in the selector portion 196). When the mandrel 102 and housing 104 are in the illustrated relative axial configuration of FIG. 7B, the port 198 in the valve selector portion 196 is axially misaligned from the ports 194 in the valve sleeve 190, which is also illustrated in the cross-sectional view of FIG. 13A, with the spring 182 removed for clarity. However, when the mandrel 102 is moved in the direction of arrow 16 to prepare for jarring, the ports 194, 198 will become axially aligned and thus allow the valve assembly 186 to become operational. In this respect, and with additional reference to the sequence of FIGS. 13B-D (also taken along line 13-13 assuming the ports 194, 196 have become axially aligned), relative rotation between the valve sleeve 190 and valve selector portion 196 in accordance with relative rotation between the mandrel 102 and the housing 104 will cause cyclical alignment and misalignment of the ports 194, 198 to effectively open and close the valve assembly 186. By appropriate timing between the lifting and dropping phases of the first and second cam structures 138, 140 within the lifting assembly 136, and of the opening and closing of the valve assembly 186, suitable operation of the jarring apparatus 100 may be achieved. In this respect, such timing may be readily facilitated by virtue of both the lifting assembly 136 and valve assembly 186 being commonly operated by relative rotation between the mandrel 102 and housing 104.

Referring again to FIG. 7B the jarring apparatus 100 further comprises a releasable axial connection 200 between the mandrel 102 and housing 104 which first needs to be disengaged to allow relative axial movement therebetween. The axial connection 200 includes a circumferential array of dogs 202 which are positioned radially between the mandrel 102 and housing 104. In the connected configuration shown in FIG. 7B the dogs 202 are received within a circumferential groove 204 in an outer surface of the mandrel, and held in place by the radial constraint of the housing 104. Upper and lower springs 206, 208 are positioned on either side of the dogs 202, and function to bias the dogs 202 towards the illustrated central position, such that the springs 206, 208 function to retain the mandrel 102 in position relative to the housing 104. In this position the mandrel 102 may be permitted to move in reverse axial directions relative to the housing 104, albeit resisted by the springs. As such, the connection may be considered to be a compliant connection. The housing 104 further includes upper and lower circumferential grooves 210, 212 which are positioned on either side of the dogs 202 when in the illustrated initial connected configuration.

Figure 14A:
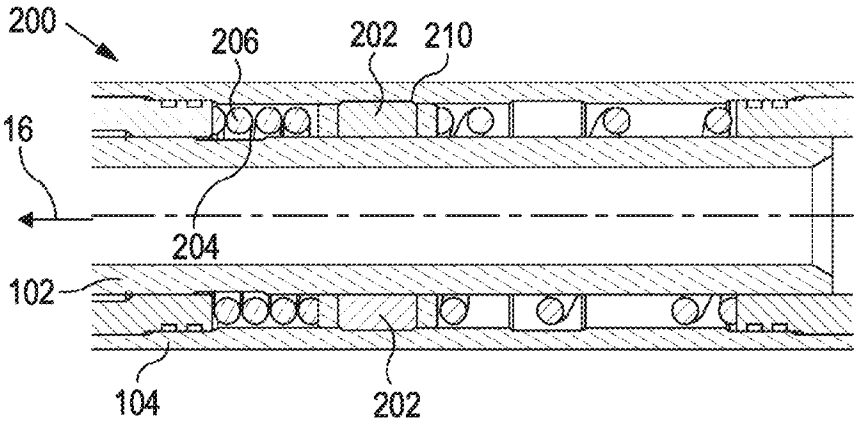
FIGS. 14A to 14B illustrate a releasable axial connection of the apparatus of FIG. 7A, shown in different configurations.
Figure 14B:
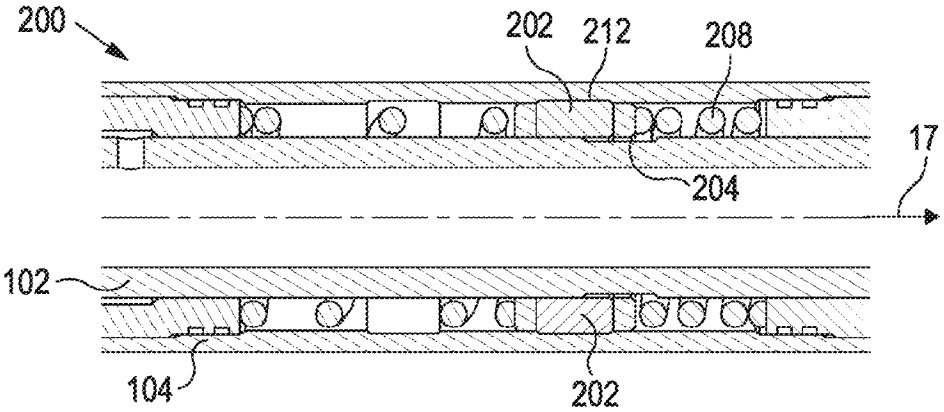

The process of releasing the axial connection, in reverse directions, is illustrated in FIGS. 14A and 14B. Referring first to FIG. 14A, a release of the mandrel 102 in the direction of arrow 16 is illustrated, which corresponds to the direction to release the rotary connection 107 (FIG. 7A) between the mandrel 102 and housing 104, and permit the spring 120 to be compressed in preparation for rotary jarring. The housing 104 is held stationary (e.g., by engagement with an object, suspended load etc.) and an axial pulling force is applied on the mandrel 102 in the direction of arrow 16, which causes the mandrel 102 and dogs 202 to move in the same direction, compressing upper spring 206. Such movement of the mandrel 102 will eventually cause the dogs 202 to become aligned with upper circumferential groove 210 in the housing 104, permitting the dogs to be released from the groove 204 in the mandrel 102, thus achieving disconnection. At this point the pulling force on the mandrel 102 will rapidly cause the mandrel 102 to move in the direction of arrow 16, radially constraining the dogs 202 in place within the upper groove 210, effectively deactivating the connection 200. In the example presented, the upper spring 206 primarily dictates the required threshold pulling force which must be exceeded to achieve disconnection.

The connection 200 may be subsequently reset, but relieving any pulling force on the mandrel 102, and/or by setting a pushing force on the mandrel 102, to re-align the groove 204 on the mandrel 102, along the dogs 202 to be released and return to the initial position.

The connection 200 may also permit axial release in a reverse direction, which is illustrated in FIG. 14B. The housing 104 is held stationary (e.g., by engagement with an object, suspended load etc.) and an axial pushing force is applied on the mandrel 102 in the direction of arrow 17, which causes the mandrel 102 and dogs 202 to move in the same direction, compressing lower spring 208. Such movement of the mandrel 102 will eventually cause the dogs 202 to become aligned with lower circumferential groove 212 in the housing 104, permitting the dogs 202 to be released from the groove 204 in the mandrel 102, thus achieving disconnection. At this point the pushing force on the mandrel 102 will rapidly cause the mandrel 102 to move in the direction of arrow 17, radially constraining the dogs 202 in place within the lower groove 212, effectively deactivating the connection 200. In the example presented, the lower spring 206 primarily dictates the required threshold pushing force which must be exceeded to achieve disconnection.

In the present example the ability to permit the described reverse axial release of the mandrel 102 in the direction of arrow 17 may function to provide a linear jar within the apparatus 100. In this respect, and again with reference to FIG. 7B, the apparatus 100 includes the pair of secondary impact surfaces 214, 216 which are caused to impact together upon axial release of the mandrel 102 in the direction of arrow 17.

Referring again to FIG. 7B the apparatus 100 incorporates various features which permits cooling of the various components during use, for example the impact surfaces 116, 118, lifting assembly 136 and spring 120. For example, the mandrel 102 includes a number of cooling ports 220 which permit fluid flowing through the apparatus 100 when in use to also function as a cooling medium. Furthermore, the mandrel 102 may also include ports (which may or may not be commonly used as cooling ports 220) to prevent hydraulic locking between the mandrel 102 and housing 104.

A full cycle of operation of the apparatus 100 will now be described with reference to FIGS. 15A to 21C.

Figure 15A:
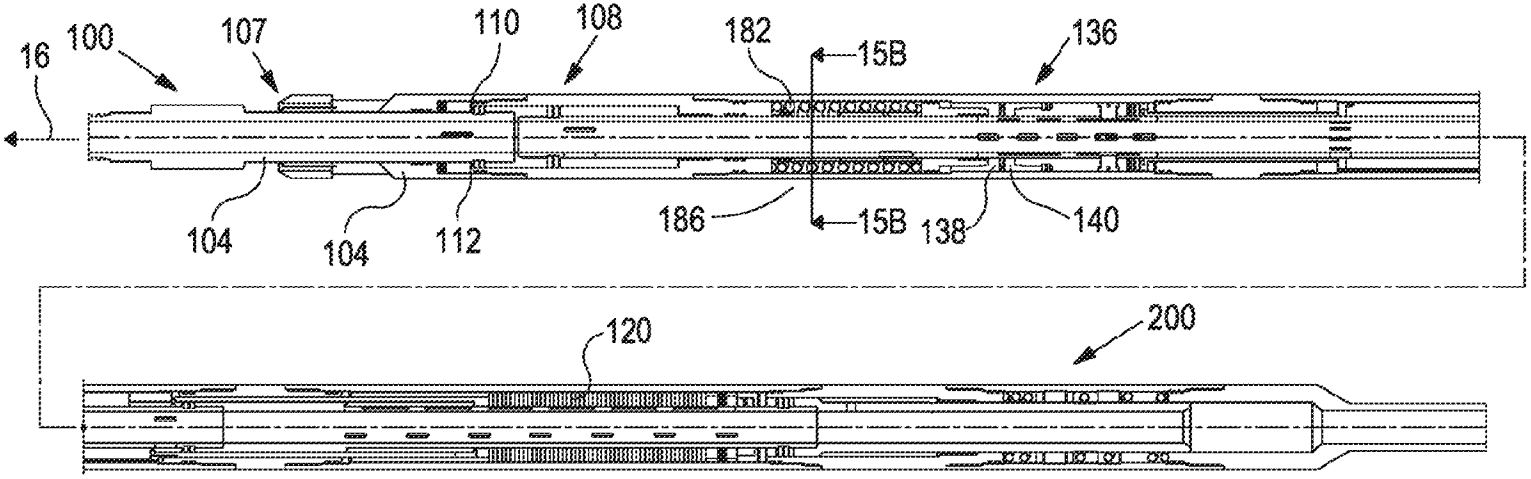
FIGS. 15A to 21C illustrate the jarring apparatus of FIG. 7A in sequential stages of operation.

Referring initially to FIG. 15A an overpull is applied on the mandrel 102 in the direction of arrow 16 (for example via a rotary drive string, such as drill pipe—not shown), which causes the axial connection 200 to be released (as described above with reference to FIG. 14A), and the rotary connection 107 between the mandrel 102 and housing 104 to be disengaged. In the illustrated configuration of FIG. 15A a very high overpull has been imparted, such that in addition to the spring 120 being compressed, the thrust assembly 108 has been engaged. As such, the apparatus 100 is shown operated in its load limit configuration.

Figure 15C:
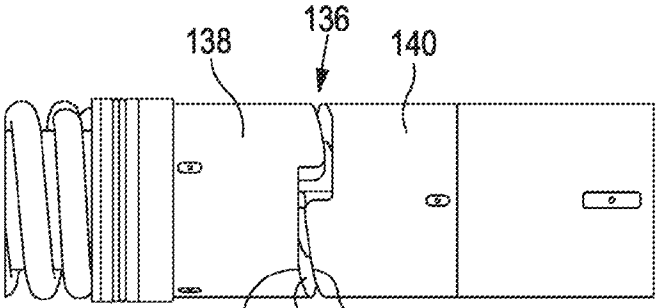
Figure 15B:
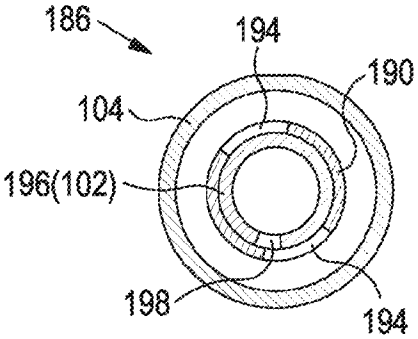

When in the configuration of FIG. 15A the valve assembly 186 is also operationally aligned, which is also shown in the cross-sectional view of FIG. 15B, taken along line 15B-15B of FIG. 15A (with the spring 182 removed in FIG. 15B for clarity). In this regard the valve assembly 186 is in an open configuration, with the port 198 in the valve selector portion 196 aligned with one of the ports 194 of the valve sleeve 190. As such, the first lifting structure 138 of the lifting assembly 136 is axially released relative to the housing 104. Although the first lifting structure 138 may be considered to be axially released from the housing 104 when the valve assembly 186 is open, the first lifting structure 138 is nevertheless biased axially towards the second lifting structure 140 by virtue of the action of the spring 182.

The corresponding configuration of the lifting assembly 136 is illustrated in FIG. 15C, wherein the first and second cam profiles 148, 158 of the lifting structures 138, 140 respectively are not engaged (separation gap 168).

Figure 16A:
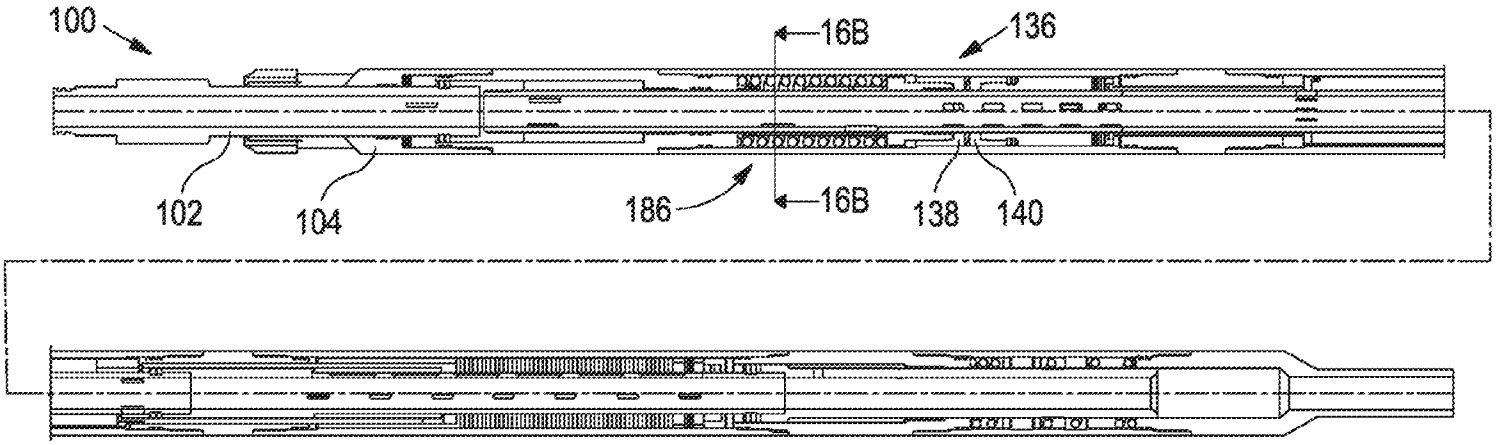
Figure 16C:
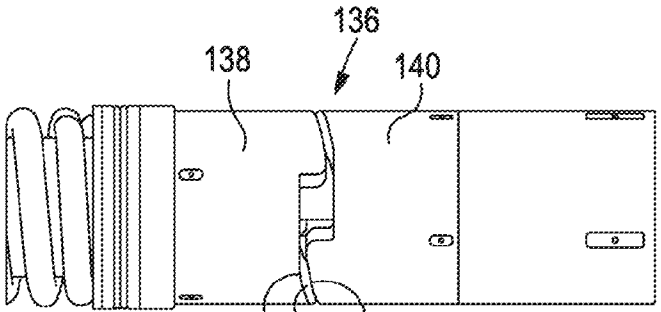
Figure 16B:
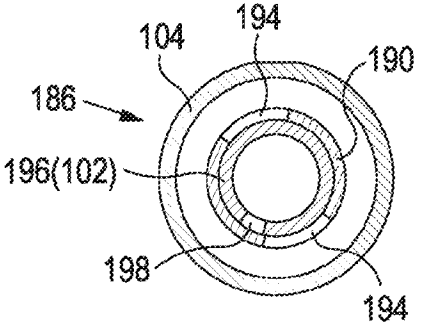

Rotation of the mandrel 102 relative to the housing 104 eventually causes the valve assembly 186 to close by misalignment of the ports 194, 198, as illustrated in FIGS. 16A and 16B, wherein FIG. 16B is a sectional view taken through line 16B-16B of FIG. 16A. The first lifting structure 138 thus becomes hydraulically locked relative to the housing 104. When in this configuration the second lifting structure 140 has rotatably progressed as shown in FIG. 16C, but the first and second cam profiles 148, 158 remain separated and non-engaged (separation gap 168). As an example, the mandrel 102 may have been rotated by around 40 degrees relative to the initial position of FIG. 15A to reach this stage in which the valve assembly 186 becomes closed.

Figure 17A:
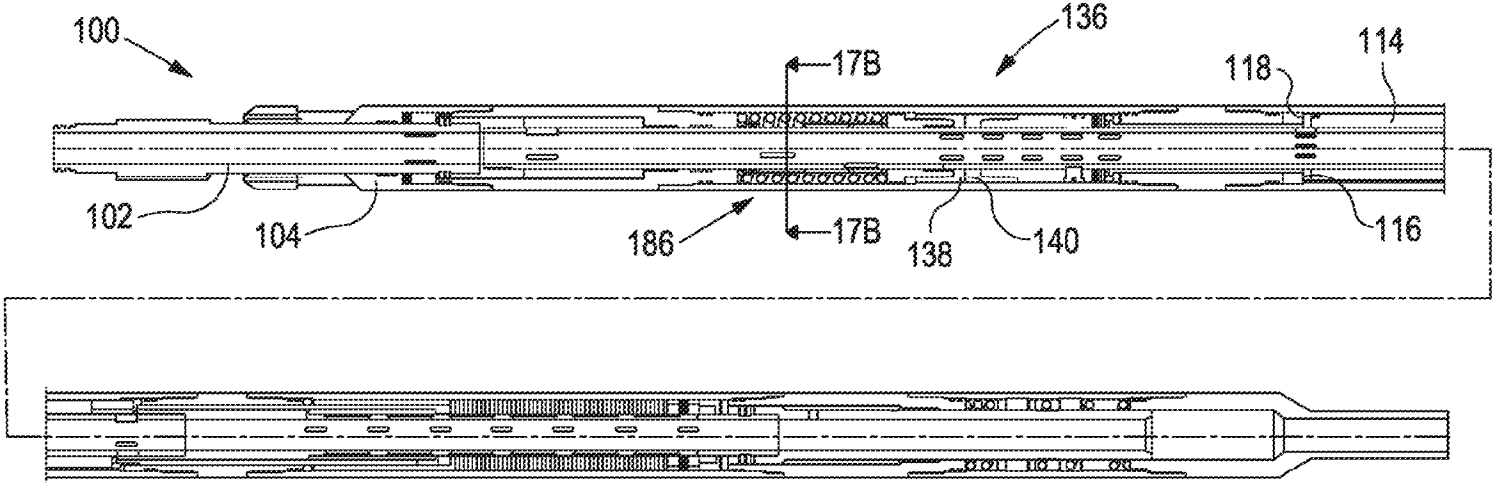
Figure 17C:
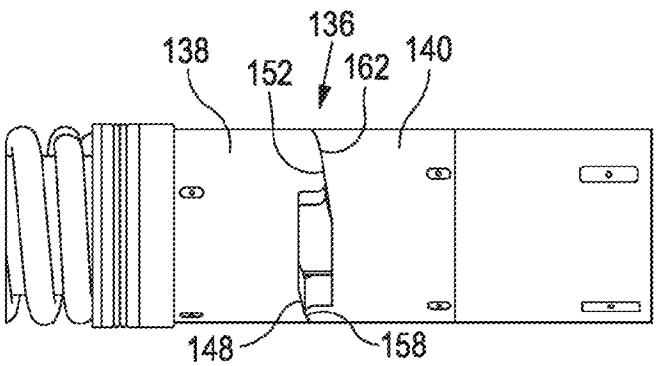
Figure 17B:
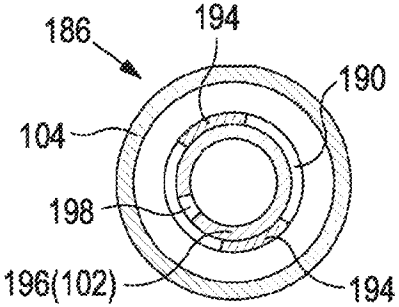

Continued rotation of the mandrel 102, illustrated in FIG. 17A, maintains the valve assembly 186 in its closed configuration, as illustrated in FIG. 17B, which is a sectional view taken through line 17B-17B of FIG. 17A, and eventually brings the cam profiles 148, 158 of the lifting assembly 136 into engagement, as illustrated in FIG. 17C. Specifically, opposing ramp portions 152, 162 become engaged in preparation to initiate the lifting phase. When in the configuration illustrated in FIG. 17A, the jarring mass 114 is positioned such that the impact surfaces 116, 118 remain engaged. As an example, the mandrel 102 may have been rotated by around 77 degrees relative to the initial position of FIG. 15A to reach this stage.

Figure 18A:
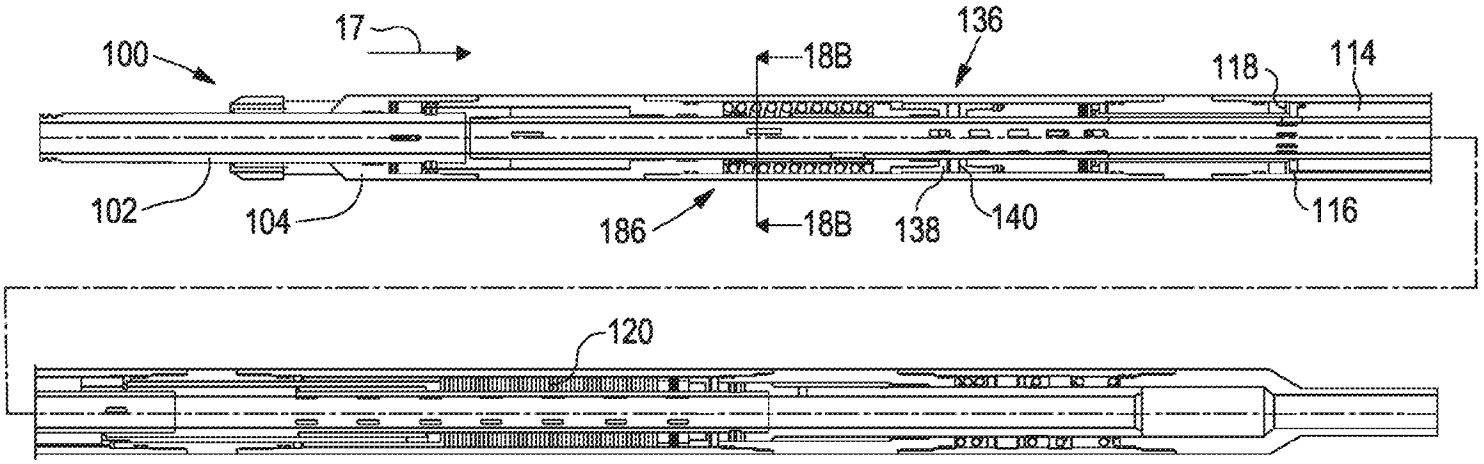
Figure 18C:
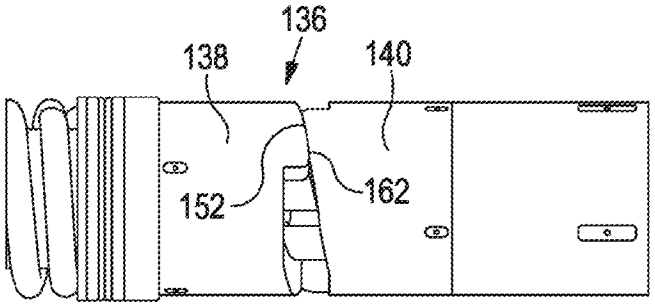
Figure 18B:
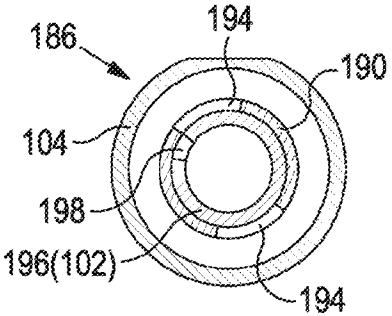

Further rotation of the mandrel 102, illustrated in FIG. 18A, maintains the valve assembly 186 in its closed configuration, as illustrated in FIG. 18B, which is a sectional view taken through line 18B-18B, and causes the ramp portions 152, 162 of the first and second lifting structures 138, 140 to slide over each other and cause relative axial displacement of said lifting structures 138, 140 to provide the lifting phase, as illustrated in FIG. 18C. By virtue of the first lifting structure 138 being hydraulically locked and axially fixed to the housing 104 the axial separation between the lifting structures 138, 140 causes the jarring mass to be moved axially in the direction of arrow 17 against the bias of the spring 120, causing the first and second impact surfaces 116, 118 to become axially separated. As an example, the mandrel 102 may have been rotated by 128 degrees relative to the initial position of FIG. 15A to reach this stage.

Figure 19A:
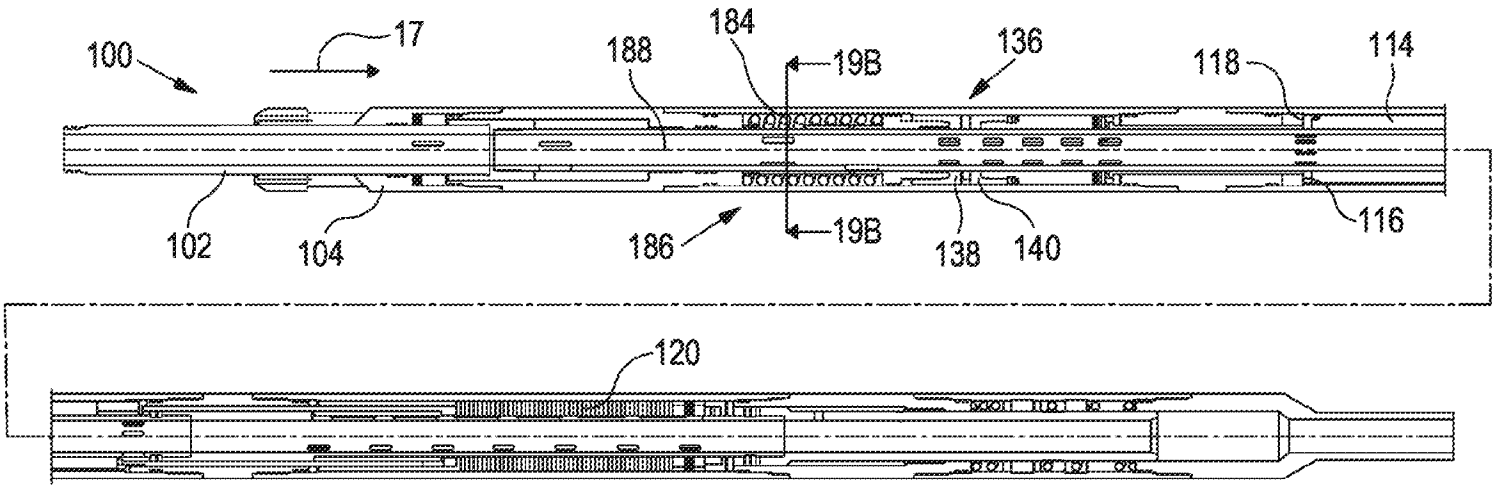
Figure 19C:
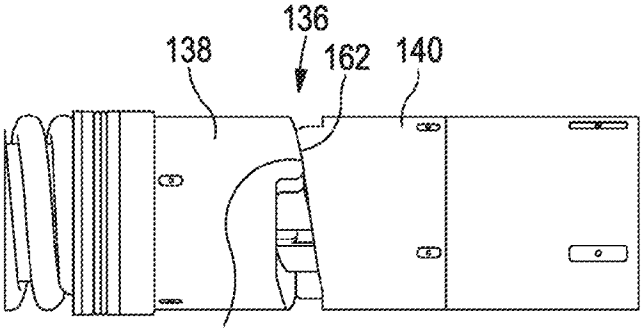
Figure 19B:
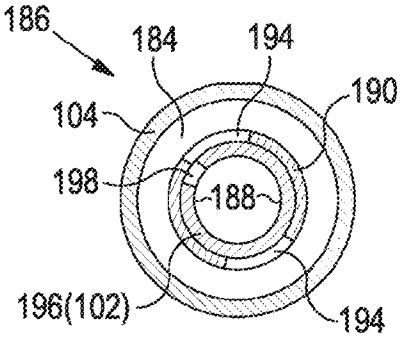

Further rotation of the mandrel 102, illustrated in FIG. 19A, causes the ports 194, 198 of the valve assembly 186 to start to become aligned, as illustrated in FIG. 19B, which is a sectional view taken through line 19B-19B, thus reconfiguring the valve assembly 186 into its open configuration. This establishes communication between the hydraulic chamber 184 and the flow path 188, axially releasing the first lifting structure 138 from the housing 104. This axial release of the first lifting structure 138 permits the loading and potential energy stored within the spring 120 to rapidly drive the jarring mass 114 in the direction of arrow 17 and cause the impact surfaces 116, 118 to be rapidly impacted together, generating a jarring force. As an example, the mandrel 102 may have been rotated by 129 degrees relative to the initial position of FIG. 15A to reach this stage of generating a jarring force within the apparatus 100.

As illustrated in FIG. 19C, the ramp profiles 152, 162 of the first and second lifting structures 138, 140 remain engaged. However, the axial release of the first lifting structure 138 from the housing 104 relieves or reduces, for example significantly reduces, loading applied between the lifting structures 138, 140, thus minimising stress therein. The timing of axial release of the first lifting structure 138 may be selected to be such that a relatively large surface area of contact between the ramp profiles 152, 162 exists during the initial lifting and loading phase, again assisting to control levels of stresses applied in the lifting assembly 136.

Figure 20A:
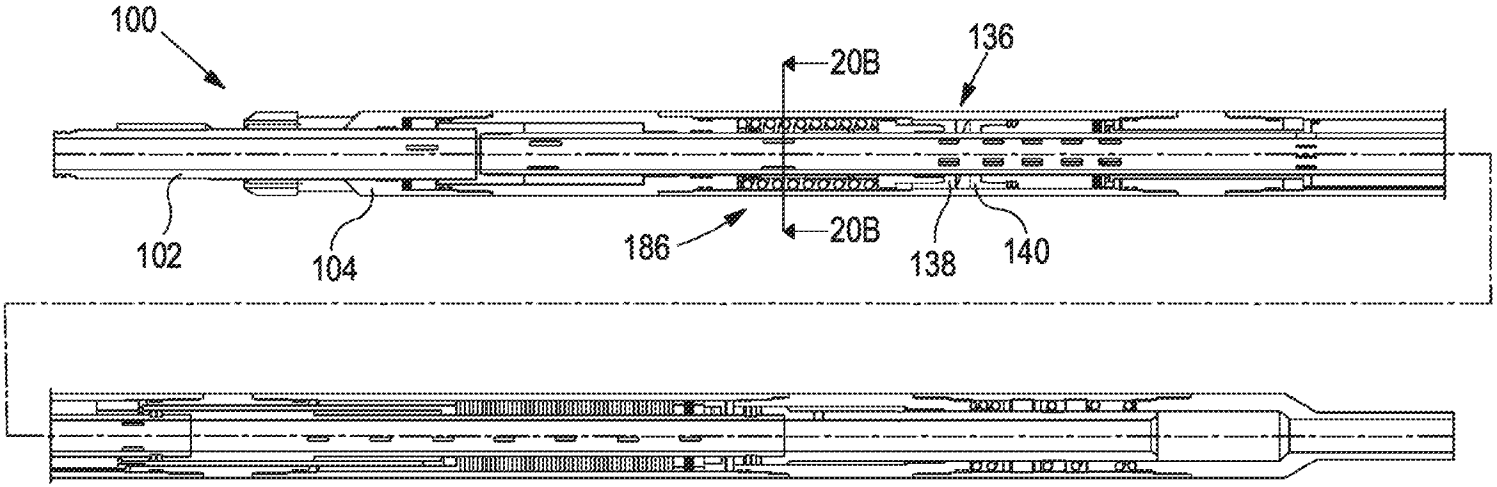
Figure 20C:
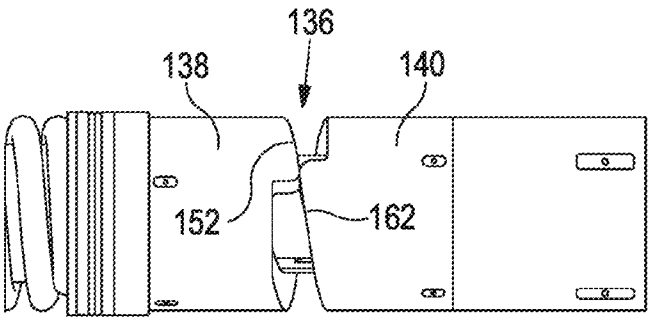
Figure 20B:
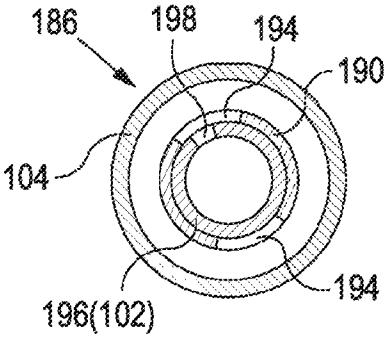
Figure 21A:
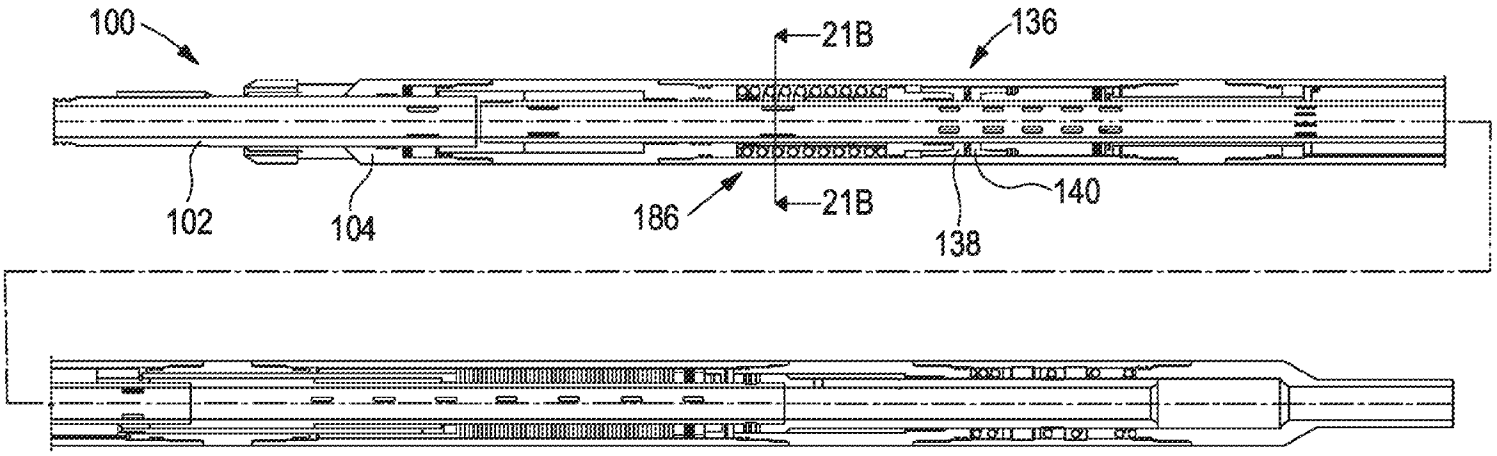
Figure 21C:
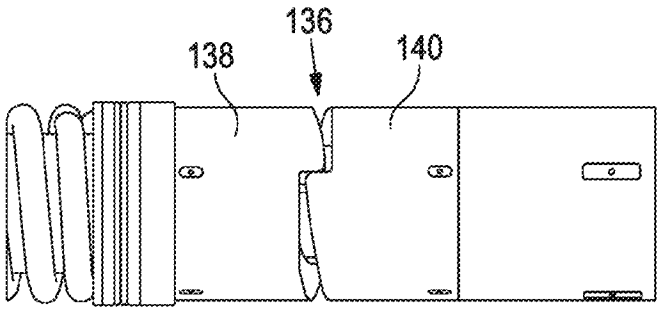
Figure 21B:
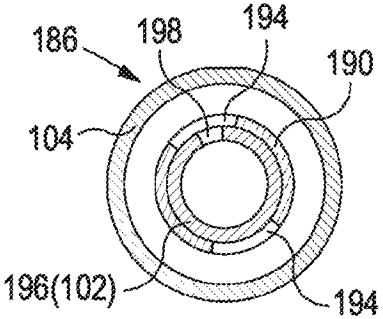

The configuration of the apparatus 100 upon further rotation of the mandrel 102 is illustrated in FIG. 20A. As shown in FIG. 20B, which is a sectional view taken through lines 20B-20B in FIG. 20A, the valve assembly 186 remains opened, with the ports 194, 198 still aligned during this further rotation. The further rotation also causes the second lifting structure 140 to further rotate relative to the first lifting structure 138, causing the ramp profiles 152, 162 to reach the peak position, as illustrated in FIG. 20C, reflecting the maximum axial displacement between the lifting structures 138, 140. As the valve assembly 186 remains open during this phase of rotation loading applied between the reducing contact area between the ramp profiles 152, 162 is minimised, thus minimising stresses within the lifting assembly 136. As an example, the mandrel 102 may have been rotated by 168 degrees relative to the initial position of FIG. 15A to reach this stage of the ramp profiles 152, 162 peaking.

Further rotation of the mandrel 102, for example now 180 degrees relative to the initial position of FIG. 15A, will cause the first and second lifting structures 138, 140 to effectively drop (i.e., the first lifting structure 138 "drops" relative to the second lifting structure 140 under the bias of spring 182), returning the apparatus 100 to the initial configuration. Continuous rotation of the mandrel 102 will cause continuous cycles of jarring, as described above. In this respect the jarring frequency will be a function of the number of cam profiles provides on the lifting structures 138, 140, and the rotational speed of the mandrel 102. The jarring frequency may also be influenced by the number of ports provided in the valve assembly 186. In use, the jarring frequency may be readily adjusted by adjusting the rotational speed of the mandrel 102.

The timing of the lifting and dropping phases of the lifting structures 138, 140 and the opening and closing of the valve assembly 186 may be readily adjusted to achieve the desired operation of the apparatus 100. For example, delaying the opening of the valve assembly 186 may permit a greater separation between impact surfaces 114, 116 to be achieved, and thus more energy to be generated by the spring 120.

The common operation of the valve assembly 186 and the lifting assembly 136 by the relative rotation between the mandrel 102 and the housing 104 may facilitate the appropriate timing of operation to be readily achieved and adjusted, for example by simple relative alignment of the different components on the mandrel 102 and/or housing 104.

Figure 22:
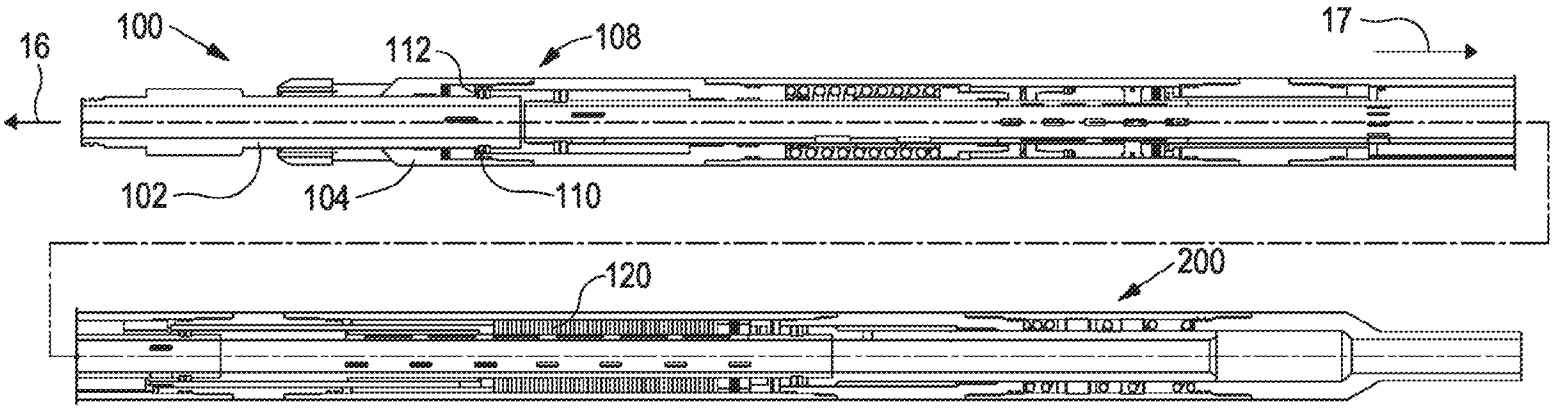
FIG. 22 illustrates the jarring apparatus of FIG. 7A in use without engagement of a thrust assembly.

In the operational example described above the overpull applied on the mandrel 102 is such that the thrust assembly 108 is engaged. In this case the force applied for each impact event will be the same as developed by the spring 120, irrespective of any increasing pulling force applied on the mandrel 102 (or alternatively increased loading applied on the housing 104). However, rotary jarring can still be achieved even before the load limit has been reached (i.e., with the thrust assembly 108 not engaged). Such an example configuration is shown in FIG. 22. In this respect the overpull applied on the mandrel 102 in the direction of arrow 16 is sufficient to release the axial connection 200 and compress the spring 120, but has not yet reached the load limit, such that the thrust surfaces 110, 112 of the thrust assembly 108 remain disengaged. The mandrel 102 may then be rotated to provide rotary jarring in the same manner described above. In this case the level of overpull applied on the mandrel 102, up to the load limit, will have a direct effect on the level of jarring forces generated, thus providing a significant degree of user flexibility.

Figure 23:
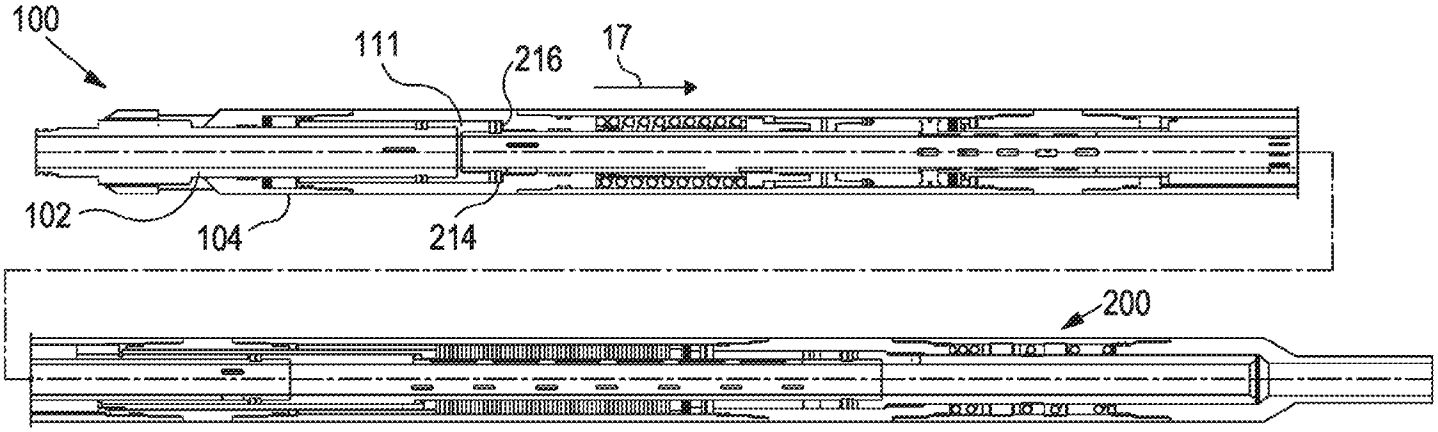
FIG. 23 illustrates the jarring apparatus of FIG. 7A performing a linear down-jar operation.

As described above, the apparatus 100 is also configured such that a linear jar can be generated in a reverse or downward direction. Such a downward linear jar operation is illustrated in FIG. 23. In this example a pushing force (e.g., weight) may be applied on the mandrel 102 in the direction of arrow 17, which will manifest through the axial connector 200. Once sufficient force is applied the connector 200 will release, in the manner described above with reference to FIG. 14B, with the energy within the mandrel (and any connected string, such as drill pipe) causing the mandrel 102 to rapidly move in the direction of arrow 17, causing impact between the secondary impact surfaces 214, 216. As the connection 200 is resettable, such a liner downjar may be repeated as required by cyclically triggering and resetting the apparatus 100.

Figure 25:
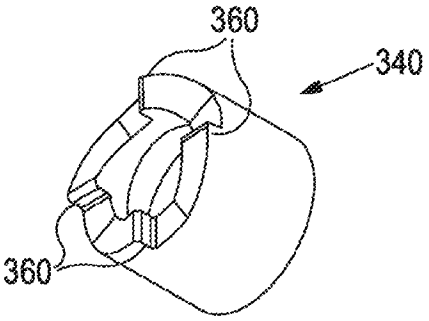
FIGS. 24 and 25 illustrate an alternative form of lifting structures of a lifting assembly which may be used in the apparatus of FIG. 7A.
Figure 24:
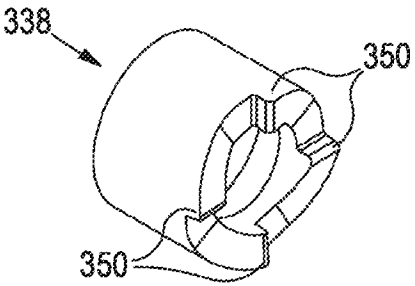

As described above, the frequency of jarring may be dictated by the form of the lifting structures 138, 140, specifically by the number of cam lobes 150, 160 present. In the example described above each lifting structure 138, 140 includes two cam lobes 150, 160, such that two jarring events may be generated for a single full 360 degrees of rotation. As such, increasing or decreasing the number of cam lobes present may alter the jarring frequency for a given rotational speed. An alternative example of a first lifting structure, in this case represented by reference numeral 338 is provided in FIG. 24, wherein four cam lobes 350 are provided. FIG. 25 illustrates a corresponding second lifting structure 340, which thus also includes four cam lobes 360.

Figure 26:
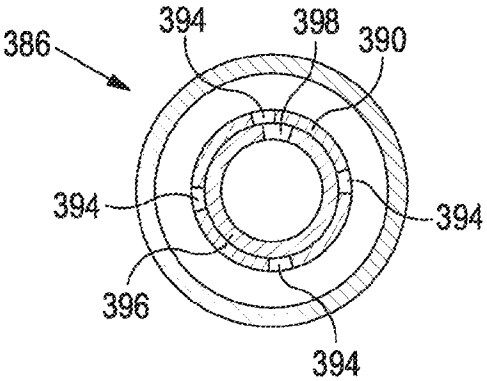
FIG. 26 is a cross-sectional view of a rotary valve which may be used in combination with the lifting structures of FIGS. 24 and 25.

With such a modified cam construction a modified valve assembly will be required to accommodate this. Such an example modified valve construction 386 is illustrated in FIG. 26, which also comprises a valve sleeve 390 and a valve selector portion 396 (forming part of a mandrel). In this example the valve sleeve 390 again includes a single port 394, however the valve selector portion 396 includes four ports to permit four cycles of locking and unlocking for each single rotation of the valve selector portion 396.

Figure 27:
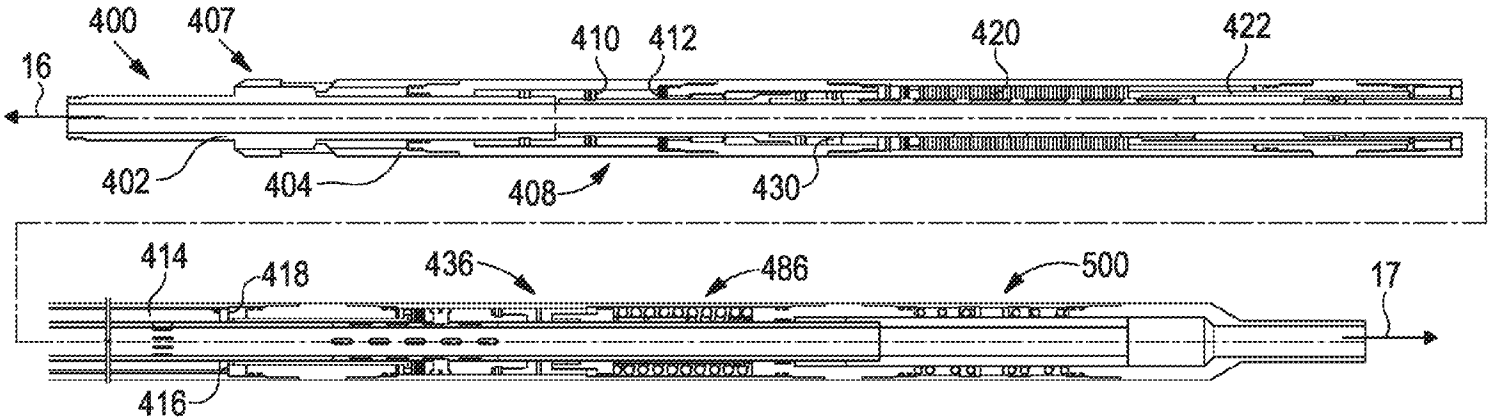
FIG. 27 is a split sectional view of a jarring apparatus according to the present disclosure.

In the example provided above the apparatus 100 is configured for rotary jarring in an uphole direction. In other examples, however, a jarring apparatus may be provided which permits rotary jarring in a downhole direction. An example of such a jarring apparatus, which is generally identified by reference numeral 400, is illustrated in FIG. 27. The apparatus 400 is similar in many respects to apparatus 100 described above, and as such like features share like reference numerals, incremented by 300. In fact, many of the features provided in the apparatus 100 are also present in apparatus 400, albeit in inverted or reverse form. As such, while the present of such features will be confirmed in the following, a detail description of these will not be repeated for brevity.

The apparatus 400 includes a mandrel 402 which extends into a housing assembly 404, wherein a releasable rotary connection 407 and a releasable axial connection 500 are provided between the mandrel 402 and housing 404, and the apparatus 400 further includes a thrust assembly 408 which includes thrust shoulders 410, 412. An axially moveable jarring mass 414 is provided radially between the mandrel 402 and housing 404, and includes a first impact surface 416 which is configured to engage a second impact surface 418 mounted on the housing 404. A force generator in the form of a spring 420 is provided within the apparatus 400 and is configured to bias the jarring mass 412, via pusher sleeve 422, in the direction of arrow 17, to engage the impact surfaces 416, 418. The mandrel 402 includes a spring pick-up ring 430 which engages and compresses the spring 420 upon movement of the mandrel 402 in the direction of arrow 17.

The apparatus 400 further comprises a lifting assembly 436 and associated valve assembly 486, which function upon relative rotation between the mandrel 402 and housing 404 to cyclically lift and drop the jarring mass 414, thus generating repeated impact between impact surfaces 416, 418.

Figure 28:
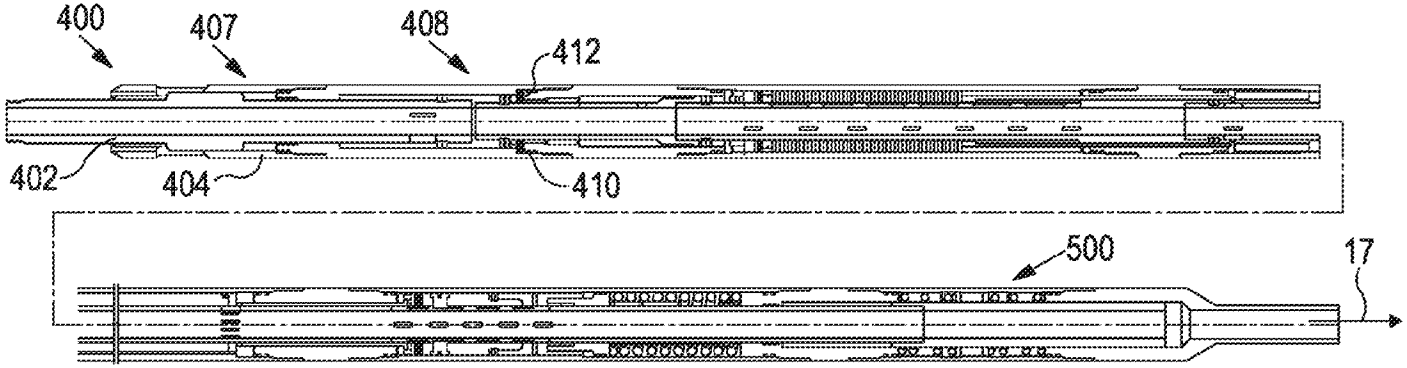
FIG. 28 illustrates the jarring apparatus of FIG. 27 in use without engagement of a thrust assembly.
Figure 29:
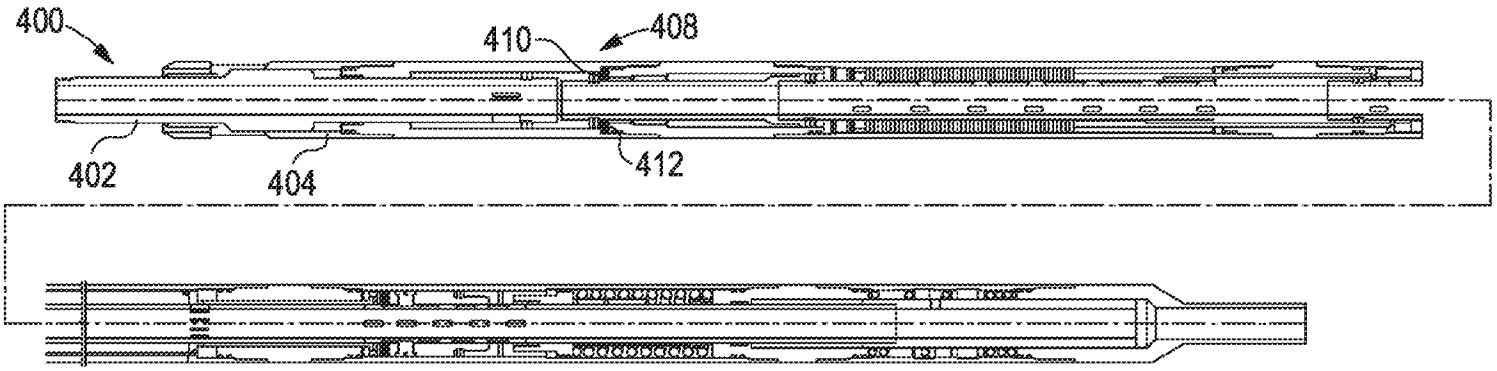
FIG. 29 illustrates the jarring apparatus of FIG. 27 in use with engagement of a thrust assembly.

When rotary jarring is required, as illustrated in FIG. 28, a force is applied on the mandrel 402 in the direction of arrow 17, which releases the axial connection 500 and subsequently the rotary connection 407, allowing the mandrel 402 to be rotated, and thus the jarring mass 414 to be reciprocated and generate repeated jarring in the same manner described above. In the illustrated example the load applied on the mandrel 402 is not yet sufficient to reach a load limit, such that the thrust shoulders 410, 412 of the thrust assembly remain disengaged. However, should the loading applied on the mandrel 402 exceed the load limit of the apparatus 400, the thrust shoulders 410, 412 of the thrust assembly 408 will engage, as shown in FIG. 29.

Figure 30:
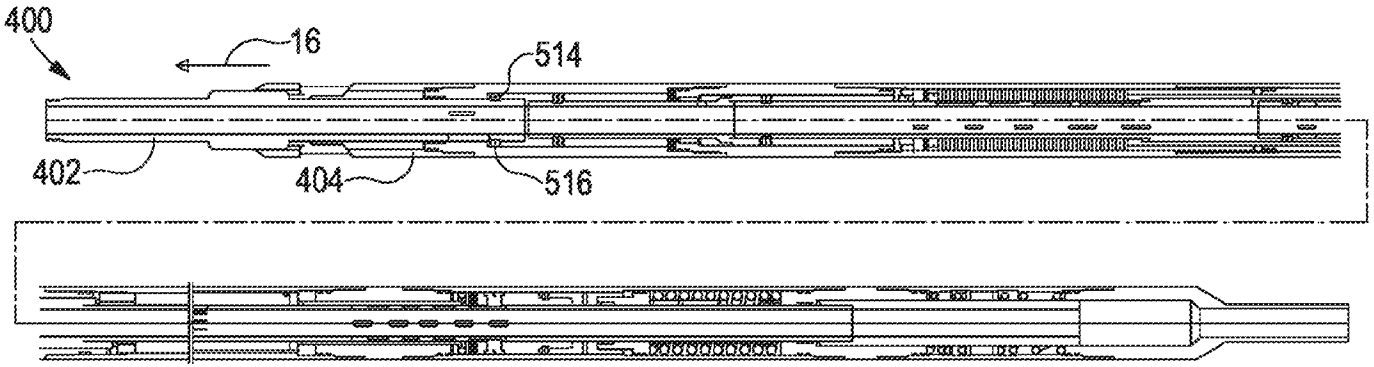
FIG. 30 illustrates the jarring apparatus of FIG. 27 performing a linear up-jar operation.

The apparatus 400 is also configured to permit linear jarring in an uphole direction, as illustrated in FIG. 30. In this respect a pulling force is applied on the mandrel 402 in the direction of arrow 16 which will cause the axial connection 500 to be released (in the manner described with reference to FIG. 14A), with the sudden release of energy causing impact between secondary impact surfaces 514, 516. As the connection 500 is resettable multiple upward linear jarring may be performed.

In the example apparatuses 100, 400 described above a hydraulic locking system is provided which cyclically hydraulically locks and releases the first lifting structure relative to the housing. Specifically, an example described above (apparatus 100) includes a valve assembly 186 incorporating radially arranged ports 194, 198 and operable to selectively isolate and communicate a hydraulic chamber 184 with a flow path 188 through the apparatus 100. However, other examples may use a different form of valve assembly, for example one which includes axial ports. Further, the function of the flow path 188 to supply and receive fluid from the hydraulic chamber 184 may be instead provided by a further hydraulic chamber. Such alternative examples will now be described with reference to FIGS. 31A to 31D.

Figure 31A:
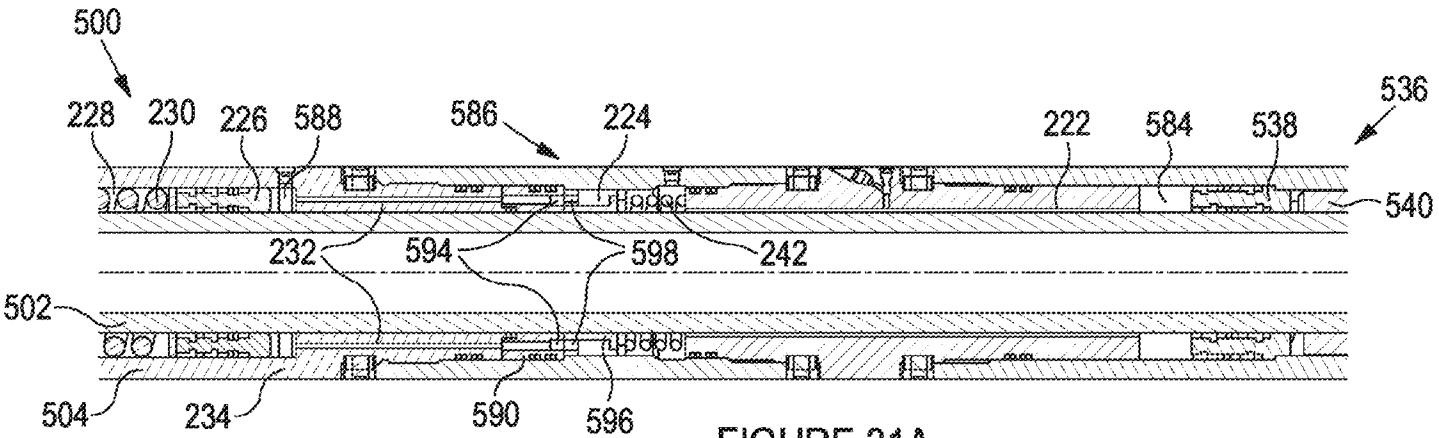
FIGS. 31A to 31D illustrate an alternative form of rotary valve which may be used in a jarring apparatus, such as any jarring apparatus disclosed herein.

Referring initially to FIG. 31A, a portion of a jarring apparatus 500 is shown in cross-section. The apparatus 500 is similar in many respects to apparatus 100 first shown in FIG. 7A, and as such like features share like reference numerals, incremented by 400. As such, not all of the apparatus 500 is illustrated and described for brevity, on the basis that the unillustrated features may be provided in accordance with earlier described examples.

The apparatus 500 includes a mandrel 502 and housing 504, and a lifting assembly 536 which includes cooperating first and second lifting structures 538, 540. The lifting assembly 536 is operated by relative rotation between the mandrel 502 and the housing 504 to cause the second lifting structure 540 to act on, directly or indirectly, a jarring mass (not shown), to permit the jarring mass to reciprocate within the apparatus and generate jarring forces. The first lifting structure 538, as in previous examples, is configured to be hydraulically locked and released relative to the housing 504 using a hydraulic locking system. In the present example, the hydraulic locking system includes a first hydraulic chamber 584 which is defined between the mandrel 502, housing 504 and the first lifting structure 538. In the present example the first hydraulic chamber 584 includes a space immediately behind the first lifting structure 538, an annular gap 222 defined between the mandrel 502 and the housing 504, and a valve chamber 224. In the present example the hydraulic locking system further includes a second hydraulic chamber 588 defined between the mandrel 502, housing 504 and a floating piston 226, wherein the floating piston 226 is sealed relative to the mandrel 502 and housing 504. The floating piston 226 is axially moveable in a radial space 228 and is spring biased by spring 230 in a direction to reduce the volume of the second hydraulic chamber 588. In the present example the second hydraulic chamber 588 includes the space immediately behind the floating piston 226 and gun drilled holes 232 through a body portion 234 of the housing 504. A volume of an incompressible hydraulic fluid, such as hydraulic oil is contained within the first and second hydraulic chambers 584, 588. In some examples, the hydraulic fluid may be pre-pressurised. This may allow or accommodate for any fluid compression, and gas compression and small leakage.

Although not illustrated, a pressure relief arrangement (e.g., a pressure relief valve) may be provided within the hydraulic locking system to prevent or minimise risk of overpressure causing damage.

A valve assembly 586 is interposed between the mandrel 502 and housing 504, and also between the first and second hydraulic chambers 584, 588, and is configurable between open and closed positions by relative rotation between the mandrel 502 and housing 504. When the valve assembly 586 is in its closed position fluid communication between the first and second hydraulic chambers 584, 588 is prevented, thus hydraulically locking the hydraulic fluid in the first hydraulic chamber 584, effectively axially fixing the first lifting structure 538 relative to the housing 504.

When the valve assembly 586 is in its open position fluid communication between the first and second hydraulic chambers 584, 588 is permitted, allowing fluid to be displaced from the first hydraulic chamber 584 to the second hydraulic chamber 588, with such fluid displacement accommodated by an increase in the volume of the second hydraulic chamber 588 by virtue of movement of the floating piston 226. Such displacement of fluid from the first hydraulic chamber 584 may effectively axially release the first lifting structure 538 from the housing 504.

The floating piston 226 may also function to accommodate thermal expansion/contraction of the fluid within the hydraulic locking system.

Figure 31D:
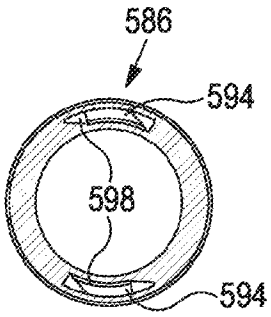
Figure 31C:
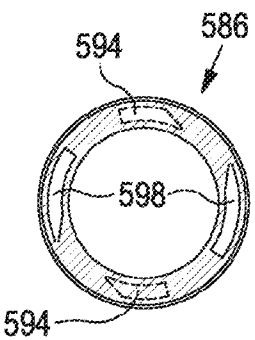
Figure 31B:
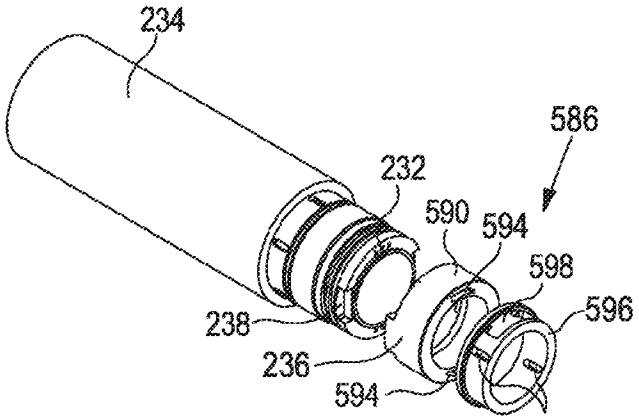

Reference is additionally made to FIG. 31B which is an exploded view of the valve assembly 586 and the body portion 234 of the housing 504, removed from the apparatus 500. The valve assembly 586 in the present example is provided in the form of a rotary gate valve assembly and comprises a gate valve nose 590 which is rotatably fixed to the piston body portion 234, and thus to the housing 504, via a pair of diametrically opposed key tabs 236 received in complimentary slots 238 in the body portion 234. In an alternative example the valve nose 590 may be integrally formed with the body portion 234/housing 502. The valve nose 590 includes two circumferentially arranged (in this case diametrically opposed) ports 594 extending axially therethrough and aligned with the gun drilled bores 232 in the body portion 234.

The valve assembly 586 further comprises a gate valve selector 596 which is rotatably fixed relative to the mandrel 502 via keys (not shown) which extend through key slots 240 in the valve selector 596. The valve selector 596 includes two circumferentially arranged ports 598 which are arranged at the same circumferential spacing as the corresponding ports 594 in the valve nose 590 (i.e., also diametrically opposed).

The valve selector 596 is axially engaged against the valve nose 590, with a gate spring 242 applying a biasing force therebetween. Relative rotation between the mandrel 502 and housing 504 causes corresponding relative rotation and sliding engagement between the valve nose 590 and the valve selector 596, thus cyclically aligning and misaligning the ports 594, 598, as illustrated in FIGS. 31C and 31D, to cyclically open and close the valve assembly 586.

In the various examples described above jarring is provided by an impact between two surfaces, specifically impact between a jarring mass and one or both of a mandrel and housing. However, a jarring or vibratory effect may be achieved without necessarily requiring impact. For example, the reciprocating action of the jarring mass, with the repeated deceleration to provide the direction change, may permit vibration or jarring to be generated. As such, while the examples above include impact surfaces, these are not essential.

Figure 32:
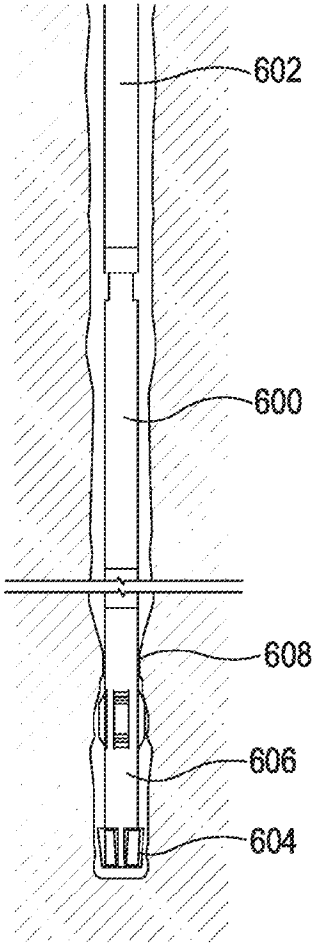

As mentioned previously, a jarring apparatus according to the present disclosure may be used in multiple different applications, whether within or outside of a wellbore environment. An example use of a jarring apparatus 600 is illustrated in FIG. 32, wherein the apparatus 600 is coupled within a drill string 602 and is used to provide jarring, when required, during the process of drilling a wellbore 604 using a drilling BHA 606. In the illustration presented a region 608 of the formed bore 604 has collapsed, generating significant friction drag against further advancement, or indeed retrieval of the drilling BHA through the restricted region. In this respect the jarring apparatus 600 may be operated to assist in overcoming the restriction 608.

Figure 33:
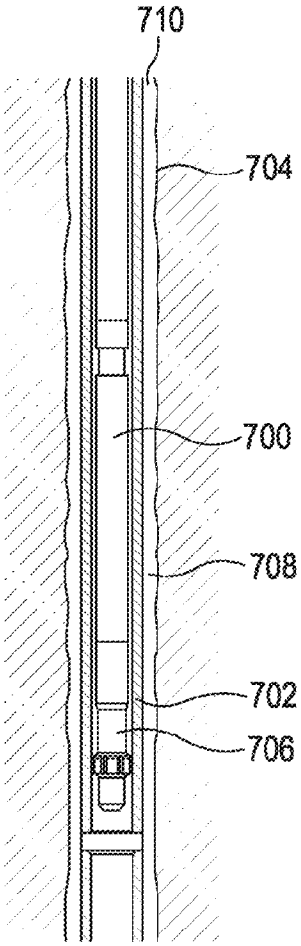

In an alternative exemplary use, illustrated in FIG. 33, a jarring apparatus 700 may be used to assist in retrieving a section of casing 702 from a wellbore 704. In this respect the jarring apparatus 700 is coupled to a casing spear 706 which is used to grip the casing portion 704. The jarring apparatus 700 may be operable to assist in freeing the casing portion 702 from cement sheath 708, or any other material, within the annulus 710 between the casing portion 702 and wellbore 704. In this example a very significant load may be carried by the jarring apparatus 700, from the weight of the casing portion 702 and the pulling force required to retrieve this from the wellbore. In some examples loads up to and beyond 4.5 MN may be necessary. In such circumstances the load limiting feature, as described in the examples above, may provide significant protection to the jarring apparatus 700.

Figure 34:
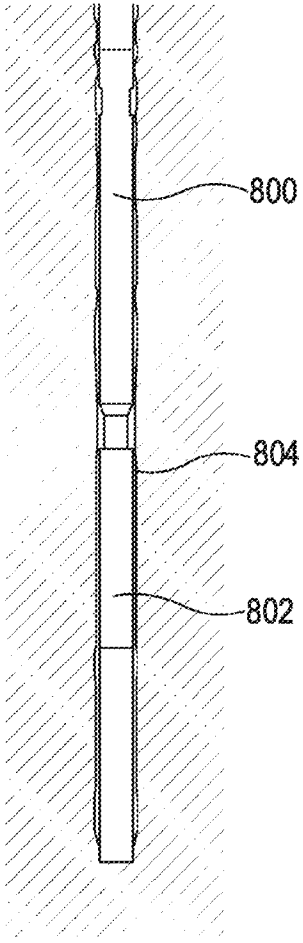
FIGS. 32 to 34 illustrate exemplary uses of a jarring apparatus according to the present disclosure.

In a further alternative exemplary use, illustrated in FIG. 34, a jarring apparatus 800 may be used in a fishing operation to assist in retrieving a tool 82 or other equipment from a wellbore 804.

Multiple other exemplary uses are possible, such as in running in equipment, in cementing operations to provide a vibration effect to encourage better cement placement, piling operations and the like.

In the examples provided above jarring is achieved by providing impact between impact surfaces. However, jarring may also be achieved without necessarily requiring such impact. Examples of jarring apparatuses which function to provide jarring without impact are illustrated in FIGS. 35 and 36.

Figure 35:
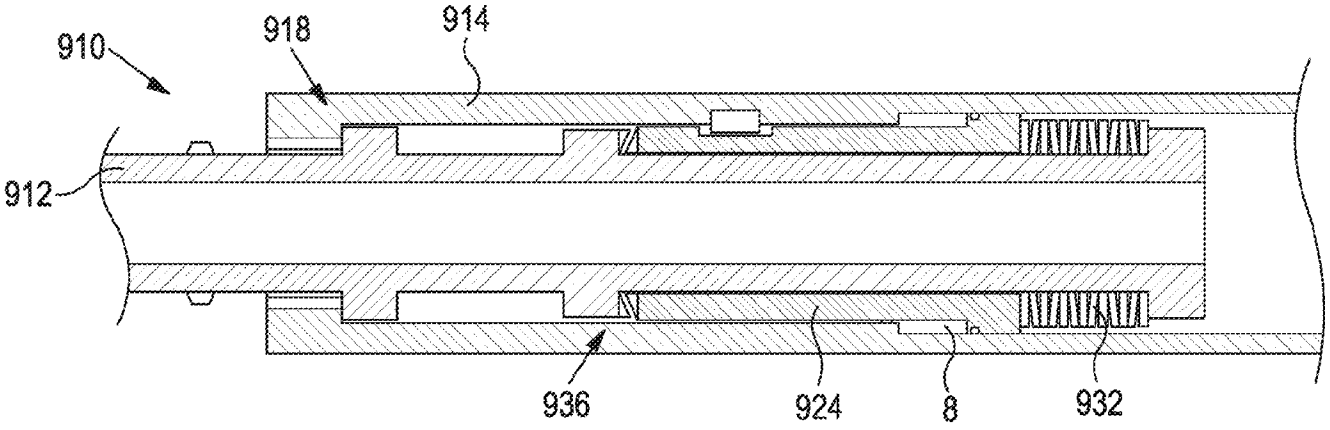
FIGS. 35 and 36 provide diagrammatic illustrations of alternative examples of a jarring apparatus.

Referring first to FIG. 35, a rotary jarring apparatus 910 is illustrated which is similar in most respects to apparatus 10 first show in FIG. 3A, and as such like features share like reference numerals, incremented by 900. Thus, the apparatus 910 includes a mandrel 912 located within a housing 914, a thrust assembly 918, a jarring mass 924, force mechanism 932 and lifting mechanism 936. However, in the present example the lifting assembly 936 includes a first lifting structure rotatably and axially fixed relative to the mandrel 912 (but alternatively could be connected to the housing 914), and a second lifting structure rotatably fixed, but axially moveable, relative to the housing 914 (but alternatively could be rotatably fixed to the mandrel 912). Further, the jarring mass 924 is rotatably connected to the housing 914 (but alternatively could be rotatably connected to the mandrel 912).

Furthermore, instead of impact surfaces, the apparatus 910 includes an arresting mechanism in the form of a gas spring 8 provided between the jarring mass 924 and the housing 914. A similar gas spring may also or alternatively be provided between the jarring mass 924 and the mandrel 912. In use, relative rotation between the mandrel 912 and housing 914 operates the lifting mechanism 936 to "lift" the jarring mass 924 against the bias of force mechanism 932, and subsequently allow the jarring mass to "drop" and be driven by action of the force mechanism 932. Such movement of the jarring mass 924 under the drive of the force mechanism 932 may be arrested by the gas spring 8, thus generating a jarring effect. Continuous operation may thus generate repeated jarring effects.

Figure 36:
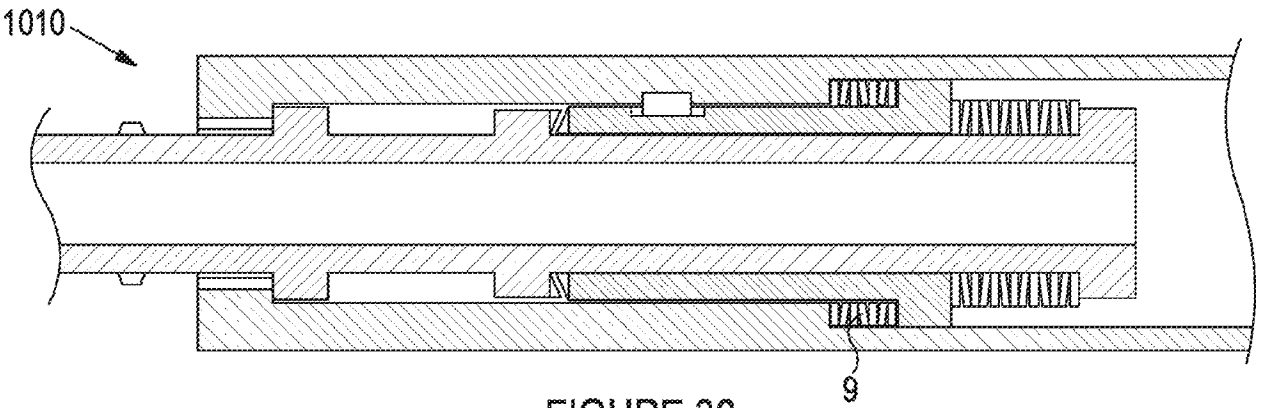

FIG. 36 illustrates a similar jarring apparatus 1010 to that shown in FIG. 34. However, in this example an arresting mechanism is provided in the form of a mechanical spring 9, such as a Belleville spring stack.

It should be recognised that the examples provided herein are indeed only exemplary, and that various modifications may be made thereto.

The invention claimed is:

1. A jarring apparatus, comprising:

first and second jarring assemblies configured to be axially moveable relative to each other between first and second axial configurations;

a thrust assembly interposed between the first and second jarring assemblies configured to limit relative axial movement therebetween at the second axial configuration and permit axial loading in one axial direction to be transferred between the first and second jarring assemblies via the thrust assembly; and a jarring mass configured to be axially moveable within the jarring apparatus in a first axial direction and a second axial direction in response to relative rotation between the first and second jarring assemblies, the first axial direction being opposite the second axial direction, wherein respective loading faces on the first and second jarring assemblies define at least a portion of the thrust assembly, wherein the respective loading faces are axially engaged when the first and second jarring assemblies reach the second axial configuration.

2. The jarring apparatus according to claim 1, further comprising:

a force mechanism configured to bias the jarring mass in the first axial direction and bias the first and second jarring assemblies in a direction towards the first axial configuration; and a lifting assembly configured to be operable by relative rotation between the first and second jarring assemblies to cyclically lift the jarring mass in the second axial direction against the bias of the force mechanism and release the lifted jarring mass to permit the jarring mass to be driven by the force mechanism in the first axial direction.

3. The jarring apparatus according to claim 2, wherein the force mechanism is of a displacement type such that the force generated within the force mechanism is a function of the relative axial movement of the first and second jarring assemblies towards the second axial configuration.

4. The jarring apparatus according to claim 2, wherein initial relative axial movement of the first and second jarring assemblies from the first configuration towards the second axial configuration is permitted without corresponding operation of the force mechanism.

5. The jarring apparatus according to claim 2, wherein the force mechanism is interposed between one of the first and second jarring assemblies and the jarring mass, and is configured to be operated on opposing sides thereof by one of the first and second jarring assembles and the jarring mass.

6. The jarring apparatus according to claim 2, further comprising a bearing structure which is interposed between the force mechanism and the jarring mass.

7. The jarring apparatus according to claim 2, comprising an arresting mechanism configured to arrest movement of the jarring mass based on moving in the first axial direction under the action of the force mechanism.

8. The jarring apparatus according to claim 7, wherein a first impact surface provided on the jarring mass and a second impact surface provided on at least one of the first and second jarring assemblies defines at least a portion of the arresting mechanism, and the first and second impact surfaces are configured to be impacted together based on the jarring mass being driven in the first axial direction under the action of the force mechanism.

9. The jarring apparatus according to claim 8, wherein the first and second impact surfaces are provided separately from the lifting assembly.

10. The jarring apparatus according to claim 2, wherein the lifting assembly comprises:

a first lifting structure rotatably and axially fixed relative to one of the first and second jarring assemblies and a second lifting structure rotatably fixed and configured to be axially moveable relative to the other of the first and second jarring assemblies, wherein the second lifting structure acts axially on the jarring mass, wherein the first and second lifting structures are configured to cooperate during relative rotation therebetween to cause the second lifting structure to be axially moved in cyclical lifting and dropping phases, wherein during the lifting phase the second lifting structure is configured to cause the jarring mass to be lifted in the second axial direction.

11. The jarring apparatus according to claim 10, wherein the second lifting structure is separately formed from the jarring mass, and the apparatus further comprises a bearing structure which is interposed between the second lifting structure and the jarring mass.

12. The jarring apparatus according to claim 10, wherein the first lifting structure is releasably axially connected to one of the first and second associated jarring assemblies such that axial release of the first lifting structure permits axial release of the jarring mass to be driven in the first axial direction by the force mechanism.

13. The jarring apparatus according to claim 12, wherein the first lifting structure is axially releasable from one of the first and second jarring assemblies prior to initiation of the dropping phase.

14. The jarring apparatus according to claim 12, wherein the first lifting structure is axially releasable from one of the first and second jarring assemblies prior to completion of the lifting phase.

15. The jarring apparatus according to claim 10, wherein the first and second lifting structures comprise inter-engaging profiles which are configured to cooperate during relative rotation of the lifting structures to cause the cyclical lifting and dropping phases.

16. The jarring apparatus according to claim 10, further comprising a locking system configured to selectively axially fix and release the first lifting structure relative to one of the first and second jarring assemblies.

17. The jarring apparatus according to claim 16, wherein the locking system is configured to be operated by relative rotational movement between the first and second jarring assemblies.

18. The jarring apparatus according to claim 16, wherein the locking system comprises a hydraulic locking system configured to hydraulically lock and release the first lifting structure relative to one of the first and second associated jarring assemblies.

19. The jarring apparatus according to claim 18, wherein the hydraulic locking system is configured to hydraulically lock a volume of hydraulic fluid axially against the first lifting structure to provide locking, and release the hydraulic fluid to provide unlocking.

20. The jarring apparatus according to claim 18, wherein the hydraulic locking system comprises a first hydraulic chamber, wherein hydraulic fluid is configured to be hydraulically locked within said first hydraulic chamber to hydraulically lock the first lifting structure relative to one of the first and second jarring assemblies.

21. The jarring apparatus according to claim 20, wherein the hydraulic locking system comprises a valve assembly which, based on the valve assembly being closed, is configured to hydraulically lock the fluid within the first hydraulic chamber, and, based on the valve assembly being open, is configured to release the hydraulically locked fluid.

22. The jarring apparatus according to claim 21, wherein the valve assembly is configurable between open and closed configurations in response to relative rotation between the first and second jarring assemblies.

23. The jarring apparatus according to claim 1, wherein the thrust assembly is configured to permit the first and second jarring assemblies to be rotatable relative to each other based on being in the second axial configuration.

24. The jarring apparatus according to claim 1, comprising a releasable rotary connection which is configurable between a connected configuration in which the first and second jarring assemblies are rotatably fixed relative to each other, and a released configuration in which the first and second jarring assemblies are rotatable relative to each other.

25. The jarring apparatus according to claim 1, comprising a releasable axial locking mechanism arranged between the first and second jarring assemblies.

26. A method for providing jarring, comprising:

establishing relative axial movement between first and second jarring assemblies of a jarring apparatus from a first axial configuration towards a second axial configuration;

limiting relative axial movement between the first and second jarring assemblies at the second axial configuration by a thrust assembly;

establishing relative rotational movement between the first and second jarring assemblies to move a jarring mass in a first axial direction and a second axial direction, wherein the first axial direction is opposite the second axial direction; and axially engaging respective loading faces on the first and second jarring assemblies based on the first and second jarring assemblies reaching the second axial configuration.

27. The method according to claim 26, wherein the establishing relative axial movement between the first and second jarring assemblies from the first axial configuration towards the second axial configuration energises a force mechanism configured to bias a jarring mass in a first axial direction.

28. The method according to claim 27, wherein establishing relative rotational movement between the first and second jarring assemblies operates a lifting assembly within the jarring apparatus which cyclically lifts the jarring mass in the second axial direction against the bias of the force mechanism and releases the lifted jarring mass to permit the jarring mass to be driven by the force mechanism in the first direction to generate a jarring force within the apparatus.

29. A method for providing jarring, comprising:

establishing relative axial movement between first and second jarring assemblies of a jarring apparatus from a first axial configuration towards a second axial configuration;

limiting relative axial movement between the first and second jarring assemblies at the second axial configuration by a thrust assembly; and establishing relative rotational movement between the first and second jarring assemblies to move a jarring mass in reverse first and second directions;

wherein the establishing relative axial movement between the first and second jarring assemblies from the first axial configuration towards the second axial configuration energises a force mechanism which functions to bias a jarring mass in a first axial direction.

* * * * *